US007541557B2

(12) United States Patent
Voloshyn et al.

(10) Patent No.: US 7,541,557 B2
(45) Date of Patent: Jun. 2, 2009

(54) METHOD FOR THERMOGRAPHIC LUMP SEPARATION OF RAW MATERIAL (VARIANTS) AND DEVICE FOR CARRYING OUT SAID METHOD (VARIANTS)

(76) Inventors: Volodymur M Voloshyn, 25/14, Lysovogo St., Kryvyi (UA) 50093; Viktor Y Zubkevych, 36/113, Meleshkina St., Kryvyi Rih (UA) 50071

( * ) Notice: Subject to any disclaimer, the term of this patent is extended or adjusted under 35 U.S.C. 154(b) by 445 days.

(21) Appl. No.: 10/561,891

(22) PCT Filed: Jun. 3, 2004

(86) PCT No.: PCT/UA2004/000036

§ 371 (c)(1),
(2), (4) Date: Dec. 22, 2005

(87) PCT Pub. No.: WO2005/118148

PCT Pub. Date: Dec. 15, 2005

(65) Prior Publication Data

US 2006/0175232 A1 Aug. 10, 2006

(30) Foreign Application Priority Data

Jun. 1, 2004 (UA) ..... 20040604130

(51) Int. Cl.
*B07C 5/00* (2006.01)

(52) U.S. Cl. ..... 209/576; 209/552; 209/586; 209/645

(58) Field of Classification Search ..... 209/576, 209/552, 586
See application file for complete search history.

(56) References Cited

U.S. PATENT DOCUMENTS

| | | | | |
|---|---|---|---|---|
| 5,124,662 | A * | 6/1992 | Downing et al. | 324/636 |
| 7,202,434 | B2 * | 4/2007 | Lofqvist et al. | 209/576 |
| 7,262,380 | B1 * | 8/2007 | Ulrichsen et al. | 209/577 |
| 2006/0175232 | A1 * | 8/2006 | Voloshyn et al. | 209/577 |

FOREIGN PATENT DOCUMENTS

| | | | |
|---|---|---|---|
| GB | 2188727 | A * | 10/1987 |
| SU | 1570777 | A1 | 6/1990 |

OTHER PUBLICATIONS

Miroshnikov, M.M. et al. "Thermal Imager—Defectoscope "Stator-1"", OMP, 1979 #12.

* cited by examiner

*Primary Examiner*—Patrick H Mackey
*Assistant Examiner*—Terrell H Matthews
(74) *Attorney, Agent, or Firm*—DeLio & Peterson, LLC; Peter W. Peterson

(57) ABSTRACT

The present interdependent group of inventions pertains to methods of and devices for lump separation of raw material and may be used in ferrous and non-ferrous metal ore dressing, concentration of mining and chemical raw materials, processing secondary raw materials and technological wastes.

The method and the device are based on the idea that a lump comprises a useful component and refuse, and such lump is exposed to ultrahigh frequency (UHF) electromagnetic field. The frequency selected is such that electromagnetic wave penetration depth will exceed the maximum linear size of a lump under conditions of maximum damping of electromagnetic wave, which depends upon characteristics of such lump material. The energy of UHF electromagnetic radiation absorbed by a lump material causes heating of the lump components. A component with higher electric conductivity will absorb UHF energy higher than UHF energy absorbed by a component with lower electric conductivity during the same period of time. As a result, after removing the UHF field the useful component and the refuse will be heated to different temperatures. A lump temperature profile will depend on mass ratio of components with different properties within such lump, and said temperature profile is registered by a thermographic system.

The invention implementation will make possible to increase the useful component content from 6~10% to 18~25% under conditions and loads unchanged, increase weight % of the useful component to 4.5% while decreasing its content in tails to 3%, decrease the total electric energy consumption by 5% due to decrease of refuse content in the raw material being concentrated.

1 Claim, 6 Drawing Sheets

METHOD FOR THERMOGRAPHIC LUMP SEPARATION OF RAW MATERIAL (VARIANTS) AND DEVICE FOR CARRYING OUT SAID METHOD (VARIANTS)

The present interrelated group of inventions relates to methods and apparatus for separating lumpy feedstock and can be used in separating ferrous and non-ferrous metal ores, mining and chemical feedstock, utility waste and processing waste material.

Known in the art is a thermographic method to study structure and foreign particulates in the object under study. The method consists in the following. Before having the object thermographed it is heated with inductive currents. As a consequence structural elements and foreign particulates acquire a high temperature. With a thermal imager, a mean temperature profile of the object is constructed and frame reference signals from the sensor are generated.

On the basis of sites with high temperature being defined, structural elements and foreign particulates are defined. (M. M. Miroshnikov, G. A. Padalko and others. Thermal Imager—Defectoscope "Stator-1": Optical-Mechanical Industry, 1979, #12, p. 17-18).

The disadvantage of this method is in its inability to make quantitative assessment of structural elements and foreign particulates.

The method bearing closely on the invention comprises feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison (USSR inventor's certificate No. 1 570 777, Int. Cl.$^5$ B03B 13/06, 1990).

The disadvantage of this method is its low selectivity. A lump of the feedstock is irradiated with electromagnetic ionizing (gamma) radiation, whose intensity while reflecting from the lump is proportionate to the averaged density of the lump and does not allow defining the weight of the lump and weight fraction of the valuable constituent in the lump directly. As a result quality of lump separation becomes worse, which leads to fouling of useful aggregate in the process of separation. The content of the valuable constituent in reject material increases and, finally, costs for its further processing increase, too.

Known in the art is a thermographic apparatus which allows to discover imperfections in the structure and foreign particulates in object under study. (M. M. Miroshnikov, G. A. Padalko and others. Thermal Imager—Defectoscope "Stator-1": Optical-Mechanical Industry, 1979, #12, p. 17-18). The prior art apparatus comprises a microwave generator with a control system, induced radiation sensors, a computing device with an input interface, a thermograph in the form of a thermal imager adapted to form a mean temperature profile of the target sample and to generate frame reference signals.

The disadvantage of this apparatus is its inability to make quantitative assessment characteristics of imperfections in the structure and foreign particulates in the object under study.

The apparatus for thermographically separating lumpy feedstock, which bears closely on the invention, comprises a feedstock lumps feeder, including a receiving bin, an electrically driven feeder, an electrically driven conveyer; a microwave generator with a control system, induced radiation sensors, and a computing device with an input interface (USSR inventor's certificate No. 1 570 777, Int. Cl.$^5$ B03B 13/06, 1990).

The disadvantage of this mechanism is its low selectivity. The density of radiation will be defined by the presence of a useful constituent only, but this apparatus does not allow defining the quantity of the useful constituent in a lump. As a result, separation quality becomes worse leading to impoverishment of the feedstock, an increase in costs and lowering of effectiveness of a further concentration process as a whole.

The present group of inventions has for its object to improve the prior art method of separating lumpy feedstock and the prior art apparatus for carrying out the method by way of creating conditions for defining quantitative characteristics of a valuable constituent in the feedstock, considering geometries of the controlled lumps and exposing them to controlled microwave radiation. For the accomplishment of this object, the following procedure is proposed. A lump comprising a valuable constituent and worthless material, each of which having different electric, magnetic and thermophysical properties, is irradiated with microwave electromagnetic field. The radiation frequency is chosen such that the depth of electric wave penetration is more than maximum linear dimension of the lump at maximum electric wave attenuation which depends on properties of the lump material. The energy of the microwave electromagnetic radiation, having been absorbed by the lump material, will cause heating of the lump components up to the temperature caused by electric, magnetic and thermophysical properties of the components. Furthermore, the component having a higher electroconductivity will absorb more microwave energy for one and the same time interval than the component with a lower electroconductivity. As a result, the heating temperature of the valuable constituent and worthless material will be different with the microwave irradiation completed. After completion of electromagnetic radiation effect, for some time, a thermal energy transfer occurs from a more heated component to a less heated one. At the same time, the character of change of lump temperature will depend on weight relationship of components with various electric, magnetic and thermophysical properties in the lump. The character of change of lump temperature with time can be registered by a thermographic system. The thermographic system is a device capable of real time transformation of heat radiation of separate adjoining sites into a corresponding signal representing a heating pattern, which signal could be input into a computing device for further processing. An example of the thermographic system can be a thermal imager. Processing the obtained heating pattern of the target lump allows to define distribution relationships of components with various electric, magnetic and thermophysical properties in the volume of the controlled lump.

This will ensure a more accurate defining of properties of the controlled lumps and thus will allow to increase effectiveness of separation and further process of concentration and processing of mining and chemical feedstock, utility waste and processing waste material.

According to the first invention the object is achieved in a method of thermographically separating lumpy feedstock, the method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, wherein each lump of the feedstock is exposed to microwave radiation, wherein upon interruption of the exposure with the heat exchanging processes between constituents of a target lump being damped, the heating pattern of the target lump is recorded wherefrom the mean temperature of the target lump is first measured and then the weight fraction of the valuable constituent in the target lump is found by the formula:

$$Q = \frac{(T_U - T_O)c}{U_O c_r - T_U(c_r - c) - T_O c},$$

wherein

Q is a weight fraction of a valuable constituent in a lump (%);

$T_U$ is the steady-state temperature of a target lump (K);

$T_O$ is the temperature of worthless material, to which it was heated (K);

$U_O$ is the temperature of a valuable constituent, to which it was heated (K);

$c_r$ is the heat capacity of a valuable constituent (J/K·kg);

c is the heat capacity of worthless material (J/K·kg);

then the condition $$Q \geqq Q_{пр},$$

wherein $Q_{пр}$ is the threshold value of the weight fraction of a valuable constituent in a lump, is verified (%).

Thereafter, from the finding of the weight fraction of the valuable constituent, the lumps of the feedstock are separated into two streams: one stream consisting of the lumps where the valuable constituent is present in an amount that is less than a predetermined threshold value, while the other stream consisting of the lumps where the valuable constituent is present in an amount that is not less than the same threshold value.

The first invention is based on specific heating of the constituents of the target lump in microwave electromagnetic field and on recording the mean steady state temperature of the lump after some time needed for attenuation of heat exchanging processes between the constituents of the lump, the temperature being proportionate to the weight ratio of the constituents in the target lump. The method can be used while separating lumpy feedstock of any structure of physical relationships of the constituents in a lump. The method is characterized by low operating speed due to attenuation time of heat exchanging processes between constituents of the lump.

The first invention is useful for thermographically separating lumpy feedstock consisting of lumps of a certain granulometric composition and any structure of physical relationships of constituent phases in a lump.

According to the second invention the object is achieved in a method of thermographically separating lumpy feedstock, the method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, wherein each lump of the feedstock is exposed to microwave radiation, wherein upon interruption of the exposure and prior to damping of the heat exchanging processes between constituents of a lump, the heating pattern of the lump is recorded wherefrom the mean temperature of the lump is measured and then the volume concentration factor of the valuable constituent in the lump is found by the formula:

$$v = \frac{2T_c - \frac{U_O \cdot T_O}{T_c} - 2T_O + U_O}{3(U_O - T_O)},$$

wherein v is a volume concentration factor of the valuable constituent;

Tc is the recorded mean temperature of a target lump (K);

$U_O$ is the temperature of a valuable constituent, to which it was heated (K);

$T_O$ is the temperature of worthless material, to which it was heated (K).

then the condition $$v > v_{пор},$$

wherein $v_{пор}$ is the threshold value of the volume concentration factor of the valuable constituent, is verified.

Thereafter, from the finding of the volume concentration factor of the valuable constituent, the lumps of the feedstock are separated into two streams: one stream consisting of the lumps where the valuable constituent is present in an amount that is less than its predetermined threshold value, while the other stream consisting of the lumps where the valuable constituent is present in an amount that is not less than the same predetermined threshold value.

The second invention is based on heating the target lump in microwave electromagnetic field and on recording the mean temperature of the lump at any non zero time after the exposure to the electromagnetic field has been discontinued and prior to the attenuation of heat exchanging processes between constituents of the lump, the temperature being proportionate to the volume ratio of the constituents in the target lump This method is useful in the separation of lumpy feedstock having homogeneous (quasi-isotropic) structure of physical interrelationships of the constituents in the lump. The operating speed of the method is dependent on the time of heating of the constituents of the lump in microwave electromagnetic field.

The second invention can be used in thermographic separation of the lumpy feedstock consisting of lumps of a certain granulometric composition and homogeneous structure of the physical interrelationships of the volumes of the constituents in a lump.

According to the third invention the object is achieved in a method of thermographically separating lumpy feedstock, the method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, wherein a lump of the feedstock is exposed to microwave radiation during the time found by the expression:

$$t_H = \frac{\Delta T c_r \rho_r}{f \pi \varepsilon_0 \varepsilon_r E_m^2 tg\delta_r},$$

wherein $t_H$ is the time of exposure of the target lump to microwave radiation (seconds);

$\Delta T$ is the required temperature rise in heating the valuable constituent (K);

$c_r$ is the heat capacity of the valuable constituent (J/K·kg);

$\rho_r$ is the density of the valuable constituent (kg/m$^3$);

f is the microwave frequency (Hz);

$\in_0$ is the electric constant equal to $8.8541878 \cdot 10^{-12}$ (F/m);

$\in_r$ is the relative permittivity of the valuable constituent;

$E_m$ is an electric intensity of microwave radiation (V/m);

$tg\delta_r$ is the tangent of the valuable constituent dielectric loss.

Wherein upon interruption of the exposure and prior to damping of the heat exchanging processes between constituents of a lump, the heating pattern of the lump is recorded wherefrom the mean temperature of the lump is measured and then the weight fraction of the valuable constituent in the target lump is found by the formula:

$$Q = \frac{\rho_r Ae}{\rho_r Ae - \rho Ae_r},$$

wherein $Ae = \pi f E_m^2 \in_0 \in tg\delta t_H - \Delta T_C \rho c$ is a fault-identifying variable of the worthless material;

$Ae = \pi f E_m^2 \in_0 \in_r tg\delta_r t_H - \Delta T_C \rho_r c_r$ is a fault-identifying variable of the valuable constituent;

Q is the weight fraction of the valuable constituent in the target lump;

$\Delta T_C$ is the mean overheating of the target lump (K);

$\rho$ is the density of the worthless material (kg/m$^3$);

$\in$ is the relative permittivity of the worthless material;

$tg\delta$ is the tangent of the worthless material dielectric loss;

then the condition $$Q > Q_{nop};$$

wherein $Q_{nop}$ is the threshold value of the weight fraction of a valuable constituent in a lump, is verified.

Thereafter, from the finding of the weight fraction of the valuable constituent, the lumps of the feedstock are separated into two streams: one stream consisting of the lumps where the valuable constituent is present in an amount that is less than its threshold value, while the other stream consisting of the lumps where the valuable constituent is present in an amount that is not less than its threshold value.

The third invention is based on heating the target lump in microwave electromagnetic field and on recording the mean temperature of the lump at any non zero time after the exposure to the electromagnetic field has been discontinued and prior to the attenuation of heat exchanging processes between constituents of the lump, the temperature being proportionate to the volume ratio of the constituents in the target lump This method is useful in the separation of lumpy feedstock having homogeneous (quasi-isotropic) structure of physical interrelationships of the constituents in the lump. The operating speed of the method is dependent on the time of heating of the constituents of the lump in microwave electromagnetic field.

The third invention can be used in thermographic separation of the lumpy feedstock consisting of lumps of a certain granulometric composition and homogeneous structure of the physical interrelationships of the constituent phases in a lump.

According to the fourth invention the object is achieved by a method of thermographically separating lumpy feedstock, which method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, wherein each lump of the feedstock is exposed to microwave radiation, the frequency of which is found by the formula:

$$f \le \frac{1}{\pi \cdot X_m \cdot \sqrt{2\varepsilon_0 \varepsilon_r \mu_0 \mu_r \left(\sqrt{1 + tg^2\delta_r} + 1\right)}} (Hz),$$

wherein $X_m$ is the maximum linear dimension of a lump (m);

$\in_0 = 8{,}85418782 \cdot 10^{-12}$ is the electric constant (F/m);

$\in_r$ is the relative permittivity of the valuable constituent;

$\mu_0 = 1{,}25663706 \cdot 10^{-6}$ is the magnetic constant (H/m);

$\mu_r$ is the relative permeability of the valuable constituent;

$tg\delta_r$ is the tangent of the valuable constituent dielectric loss.

The heating time is calculated by the formula:

$$t_f = \frac{\Delta T c_r \rho_r}{f \pi \varepsilon_0 \varepsilon_r E_m^2 tg\delta_r}; (s),$$

wherein $\Delta T$ is the required temperature rise in heating the valuable constituent (K);

$c_r$ is the specific heat capacity of the valuable constituent (J/K·kg);

$\rho_r$ is the density of the valuable constituent (kg/m$^3$);

$\in_r$ is the relative permittivity of the valuable constituent;

$E_m$ is the intensity of the electromagnetic field (V/m).

Thereafter, upon interruption of the exposure and prior to cessation of the heat exchanging processes between constituents of the lump, the heating patterns of the lump are repeatedly recorded, wherefrom mean temperatures of the target lump are measured and from the measurements, a set of equations is formed:

$$\begin{cases} T_0 = X_1 + X_2 t_0 + X_3 t_0^2 + X_4 t_0^3 \\ T_1 = X_1 + X_2 t_1 + X_3 t_1^2 + X_4 t_1^3 \\ T_2 = X_1 + X_2 t_2 + X_3 t_2^2 + X_4 t_2^3 \\ T_3 = X_1 + X_2 t_3 + X_3 t_3^2 + X_4 t_3^3 \end{cases},$$

wherein $T_0$, $T_1$, $T_2$, $T_3$ denote the mean temperature of the lump, taken at times $t_0$, $t_1$, $t_2$, $t_3$.

The set of equations is solved for $X_1$, $X_2$, $X_3$, $X_4$, whereupon the volume ratio of the valuable constituent is determined by the formula:

$$Kv = \frac{c\rho\,(X_3 a c_r \rho_r + 3X_2 k_r)}{c\rho\,(X_3 a c_r \rho_r + 3X_2 k_r) - 3X_2 c_r \rho_r k},$$

wherein c is the heat capacity of the worthless material (J/K·kg);

ρ is the density of the worthless material (kg/m$^3$);

α is the particle size of the valuable constituent (m).

$k_r$ is the heat transfer coefficient of the valuable constituent (W/K·m$^2$);

k is the heat transfer coefficient of the worthless material (W/K·m$^2$).

Then the condition $$Kv > Kv_{nop},$$

wherein $Kv_{nop}$ is the threshold value of volume ratio of the valuable constituent, is verified.

Thereafter, from the finding of the volume ratio of the valuable constituent, the lumps of the feedstock are separated into two streams: one stream consisting of the lumps where the valuable constituent is present in an amount that is less than a predetermined threshold value, and the other stream consisting of the lumps where the valuable constituent is present in an amount that is not less than the same predetermined threshold value.

The fourth invention is based on the heating of the target lump by microwave radiation and on the repeated recordings of the lump mean temperature at discrete instants within the period from the interruption of the exposure and prior to cessation of the heat exchanging processes between constituents of the lump. From the data obtained as a result of the repeated recordings, the ratio of volumes of phases of the lump constituents is defined. The method is useful in the separation of lumpy feedstock consisting of lumps of any structure of physical relationships of constituents. The operating speed of the method is dependent on the time of heating of the lump constituents in microwave electromagnetic field and on the time of repeated recording of the lump temperature.

The fourth invention can be used for the thermographic separation of lumpy feedstock consisting of lumps of certain granulometric composition and homogeneous and heterogeneous structure of physical relationships of constituent phases in a lump.

According to the fifth invention the object is achieved by a method of thermographically separating lumpy feedstock, which method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, wherein each lump of the feedstock is exposed to microwave radiation until the constituents of the lump are heated and upon interruption of the exposure and following the time required for the heat exchanging processes between constituents of the lump to cease, the heating pattern of the target lump is recorded by means of a thermographic system and the difference between the maximum and the minimum temperatures of the lump is determined from the recorded heating pattern, and from the difference between the maximum and the minimum temperatures and the known time from the interruption of the exposure to the recording of the heating pattern of the lump the weight fraction of the valuable constituent in the lump is found by the formula:

$$Q = \frac{cc_r \ln\left(\frac{U_O - T_O}{\Delta T(t_k)}\right) - \frac{6k_r c t_K}{a\rho_r}}{cc_r \ln\left(\frac{U_O - T_O}{\Delta T(t_k)}\right) + \frac{6(kc_r - k_r c)t_k}{a\rho_r}},$$

wherein

Q is the weight fraction of the valuable constituent in the target lump $U_O$ is the temperature, to which the valuable constituent was heated (K);

$T_O$ is the temperature of the worthless material, to which it was heated (K);

$\rho_r$ is the density of the valuable constituent (kg/m$^3$);

$c_r$ is the heat capacity of the valuable constituent (J/K·kg);

c is the heat capacity of the worthless material (J/K·kg);

$k_r$ is the heat transfer coefficient of the valuable constituent (W/K·m$^2$);

k is the heat transfer coefficient of the worthless material (W/K·m$^2$);

$t_K$ is the time from the interruption of the exposure to the recording of the heating pattern of the lump (seconds);

α is the particle size of the valuable constituent in the target lump (m);

$\Delta T(t_K)$ is the difference between the minimum and the maximum temperatures of the lump as determined at the time of recording the heating pattern of the same lump (K).

Then the condition $$Q \geqq Q_{nop},$$

wherein $Q_{nop}$ is the threshold value of the weight fraction of the valuable constituent, is verified.

Thereafter, from the finding of the weight fraction of the valuable constituent, the lumps of the feedstock are separated into two streams: one stream consisting of the lumps where the valuable constituent is present in an amount that is less than a predetermined threshold value, and the other stream consisting of the lumps where the valuable constituent is present in an amount that is not less than the same predetermined threshold value.

The fifth invention is based on the heating of the target lump by microwave radiation and on the recording of the difference between the lump maximum and minimum temperatures at a certain instant within the interval from the interruption of the exposure and prior to cessation of the heat exchanging processes between constituents of the lump. The difference between the temperatures obtained will be proportional to the weight ratio of the lump constituents. The method is useful in the separation of lumpy feedstock consisting of lumps of dissimilar, uniformly distributed structure of physical relationships of constituents within the lump. The operating speed of the method is dependent on the time of heating of the lump constituents in microwave electromagnetic field.

The fifth invention can be used for the thermographic separation of lumpy feedstock consisting of lumps of certain granulometric composition and dissimilar, randomly distributed structure of physical relationships of constituent phases within the lump.

According to the sixth invention the object is achieved by an apparatus for thermographically separating lumpy feedstock, comprising an arrangement for feeding feedstock lumps, including a receiving bin, an electrically driven feeder, an electrically driven conveyer, a microwave generator with a control system, induced radiation sensors, and a computing device with an input interface, wherein the apparatus further comprises a microwave heating chamber connected to the microwave generator, a thermographic system for processing signals from temperature-sensitive elements capable of detecting induced heat radiation, a control system for the feeder electric drive, a rolling handler, a control system for the conveyer electric drive, a narrow-beam light emitter and a photodetector, a position sensor, the output of the thermographic system is connected to the first input of the input interface, the output of the input interface is connected via the computing device to the input of the output interface, the second output of the output interface is connected to the control system for the feeder electric drive, the third output of the output interface is connected via the microwave generator control system to the input thereof, the fourth output of the output interface is connected to the control system of the conveyer electric drive, on the shaft thereof the position sensor is installed and connected to the second input of the input interface, wherein the first output of the output interface via a comparator, a time delay unit and a control pulse shaper is connected to a solenoid-operated pneumatic valve arranged so as to interact with a separator for directing to the receptacle of the feedstock lumps, where the valuable constituent is present in an amount that that is less than a predetermined threshold value, and to the receptacle of the feedstock lumps, where the valuable constituent is present in an amount that is not less than the same threshold value.

The sixth invention is based on:

1. Forming a one-layer stream of the lumpy material for separation.
2. Exciting heat radiation in the target lumpy material by means of high-energy microwave electromagnetic field.
3. Sensing induced heat radiation from each lump. In accordance with the data obtained, values of separation parameters are defined (for example, dimensions, position, weight, valuable constituents content, etc.).
4. Generating a separation action for changing the path of the target lump as a function of the comparison of separation parametric values obtained on the sensing step with predetermined threshold values.

The sixth invention can be used for thermographic separation of lumpy feedstock consisting of lumps of certain granulometric composition as a heterogeneous system of phases of valuable constituents and worthless material with heterogeneous, randomly distributed structures of physical relationships of the constituents of the lump.

According to the seventh invention the object is achieved by an apparatus for thermographically separating lumpy feedstock comprising an arrangement for feeding feedstock lumps, including a receiving bin, an electrically driven screw feeder, an electrically driven conveyer; a microwave generator with a control system, induced radiation sensors, and a computing device with an input interface, which apparatus further comprises a microwave heating chamber connected, via an element for transmitting electromagnetic energy in the microwave spectrum, to the microwave generator, and housing a rolling handler consisting of rollers made from heat resistant dielectric material and a decelerating comb with teeth spacing equal to ¼ the wavelength of microwave radiation arranged between the rolls and the discharge unit of the microwave heating chamber is provided with a microwave trap having quarter wave reflectors, the apparatus further comprises a thermographic system for processing signals, a control system for the screw feeder electric drive, a control system for the conveyer electric drive, a narrow-beam light emitter and a photodetector, a position sensor, the output of the thermagraphic system is connected to the first input of the input interface, the output of the input interface is connected via the computing device to the input of the output interface, the second output of the output interface is connected to the control system for the screw feeder electric drive, the third output of the output interface is connected via the microwave generator control system to the input thereof, the fourth output of the output interface is connected to the control system of the conveyer electric drive, on the shaft thereof the position sensor is installed and connected to the second input of the input interface, wherein the first output of the output interface via a comparator, a time delay unit and a control pulse shaper is connected to a solenoid-operated pneumatic valve arranged so as to interact with a separator for directing to the receptacle of the feedstock lumps, wherein the valuable constituent is present in an amount that is less than a predetermined threshold value, and to the receptacle of the feedstock lumps, wherein the valuable constituent is present in an amount that is not less than the same threshold value.

The seventh invention is based on:

1. Forming a one-layer stream of the lumpy material for separation.
2. Exciting in the target lumpy material intensive and even heat radiation by means of high-energy microwave electromagnetic field.
3. Heating up the target lump material by applying the comb structure of the decelerating system.
4. Sensing induced heat radiation from each lump. In accordance with the data obtained, values of separation parameters are defined (for example, dimensions, position, weight, valuable constituents content, etc.).
4. Generating a separation action for changing the path of the target lump as a function of the comparison of separation parametric values obtained on the sensing step with predetermined threshold values.

The seventh invention can be used for thermographic separation of lumpy feedstock consisting of lumps of certain granulometric composition with heterogeneous, randomly distributed structures of physical relationships of the constituents of the lump.

The inventions will now be further described with reference to the accompanying drawings, in which.

Figure 1:
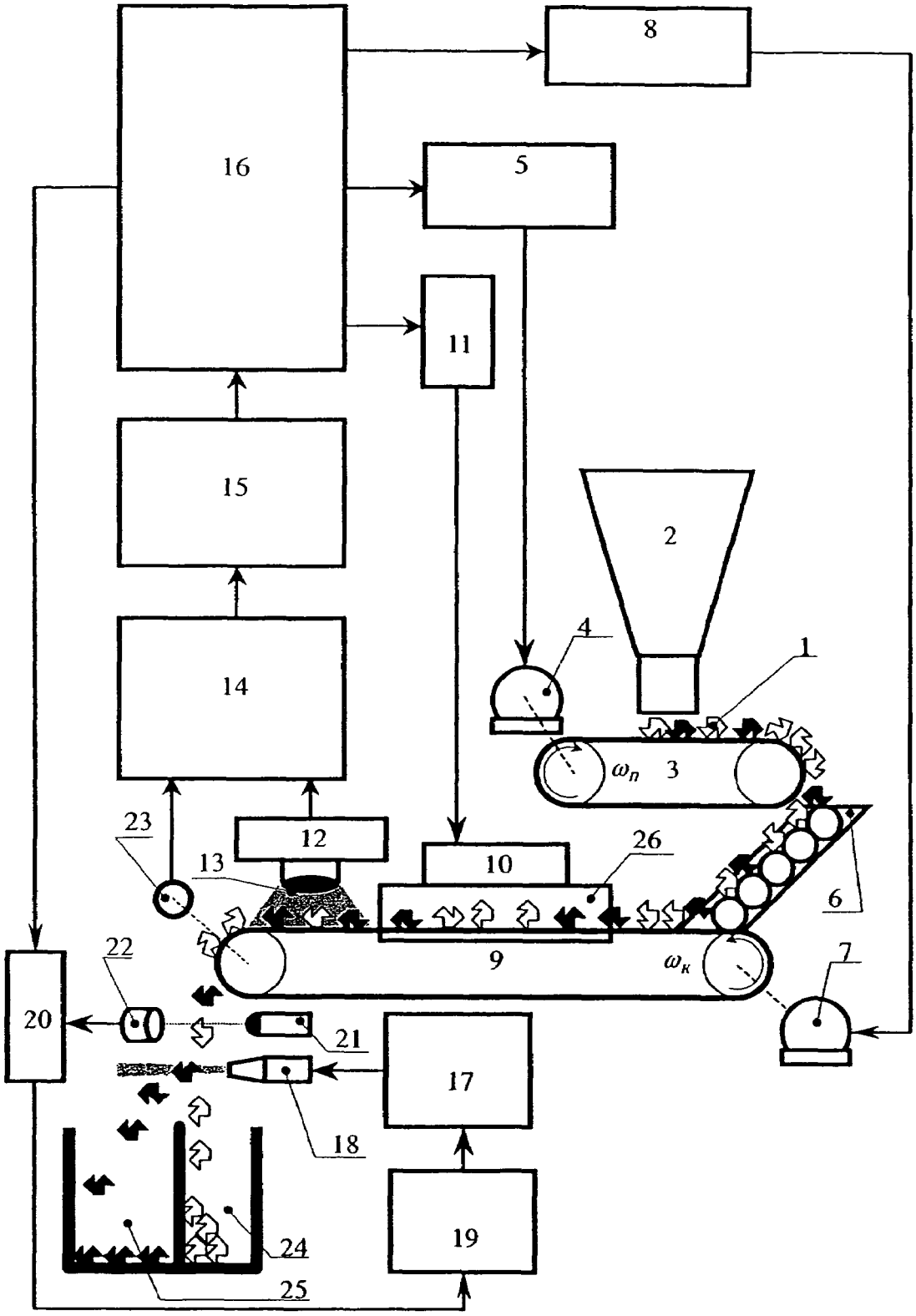
FIG. 1 is a schematic representation of a first apparatus for thermographically separating lumpy feedstock, one embodiment.

The first method can be embodied by the example of concentration of metal-comprising feedstock, ores of ferrous and non-ferrous metals. The proposed method provides a feedstock separation which is performed in two streams: one stream comprises the lumps whose valuable constituent content is more than a preset value and another stream comprises the lumps whose valuable constituent content is less than a preset value. The feedstock subjected to separation can be the feedstock obtained directly after sloughing in the process of mining operations as well as the feedstock in the form of rock mass, which was subjected to additional ragging up to preset dimensions of a medium lump.

The feedstock moves from a proportioning loader onto the conveyer. The computing device via the output interface forms a control signal for lump dosed feeding device onto the belt and a control signal for the conveyer electric drive control system. The conveyer conveys the lump into a zone of microwave electromagnetic field heating. In the zone, a required electromagnetic radiation power is produced at the command of the computing device.

The electromagnetic radiation wavelength in the substance under control is found from the expression:

$$\lambda=2\pi X_m,(m) \quad (1),$$

where $\lambda$—wavelength in substance under control (m);

$X_m$—penetration depth of electromagnetic wave in substance (m).

On the other hand, the wavelength in substance can be found from the expression:

$$\lambda = \frac{V}{f};\ (\mathcal{M}), \quad (2)$$

where

V—phase speed of electromagnetic wave in the given substance (m/s);

f—electromagnetic radiation frequency (Hz).

According to (1) and (2) we can write the following:

$$2\pi X_m = \frac{V}{f}, \quad (3)$$

or, having solved the expression (3), we will obtain the following:

$$X_m = \frac{V}{2\pi f}(\mathcal{M}). \quad (4)$$

The phase speed of electromagnetic wave in the given environment can be found from the expression (See [1] p. 167):

$$V = \frac{\sqrt{2}}{\sqrt{\varepsilon_0\varepsilon_\beta\mu_0\mu_\beta\left(\sqrt{1+tg^2\delta_\beta}+1\right)}}, \quad (5)$$

wherein $\in_0$ is the electric constant equal to $8.8541878\cdot10^{-12}$ (F/m);

$\in_\beta$ is a relative dielectric permittivity of a substance;

$\mu_0$ is the magnetic constant equal to $1.25663706\cdot10^{-6}$ (H/m);

$\mu_\beta$ is a relative magnetic conductivity of a substance;

$tg\delta_\beta$ is the tangent of dielectric loss of a substance.

Substituting expression (5) for expression (4) and having made the transformations, we will obtain:

$$X_m = \frac{1}{\pi f\sqrt{2\varepsilon_0\varepsilon_\beta\mu_0\mu_\beta\left(\sqrt{1+tg^2\delta_\beta}+1\right)}}. \quad (6)$$

Having solved expression (6) as respects f we will get:

$$f = \frac{1}{\pi X_m\sqrt{2\varepsilon_0\varepsilon_\beta\mu_0\mu_\beta\left(\sqrt{1+tg^2\delta_\beta}+1\right)}}. \quad (7)$$

Expression (7) presents electromagnetic wave frequency for which amplitude of electric field strength becomes 2.71 times less upon the wave's passing the distance in the line of transmission in the given substance equal to Xm.

The microwave electromagnetic field frequency must be such as to ensure penetration of microwave radiation electromagnetic waves at a certain depth of the controlled lump. Taking into consideration (7), this frequency can be found from the inequality:

$$f \le \frac{1}{\pi\cdot X_m\cdot\sqrt{2\varepsilon_0\varepsilon_r\mu_0\mu_r\left(\sqrt{1+tg^2\delta_r}+1\right)}}(Hz), \quad (8)$$

where $\in_r$—relative permittivity of valuable constituent;

$\mu_r$—relative magnetic conductivity of valuable constituent;

$tg\delta_r$—tangent of dielectric loss of valuable constituent.

Under the effect of microwave energy the heating of feedstock lump occurs due to the lump's absorbing of microwave electromagnetic field energy.

Volume power density of electromagnetic field, absorbed by substance, is found from the expression:

$$W = f\pi\varepsilon_0\varepsilon_{\hat{a}}E_m^2 tg\delta_{\hat{a}}t_{H\hat{a}},\ \left(\frac{J}{m^3}\right), \quad (9)$$

where $E_m$—microwave electric field strength (V/m);

$t_{H\beta}$—time of effect of microwave electromagnetic radiation on substance (s).

And temperature increase of unit volume of substance will be given by:

$$\Delta T_{\hat{a}} = \frac{W}{c_{\hat{a}}\rho_{\hat{a}}}(\hat{E}), \quad (10)$$

where $\Delta T_\beta$—required temperature increase of substance (K);

$c_\beta$—heat capacity of substance (J/K kg);

$\rho_\beta$—density of substance (kg/m$^3$).

Taking into consideration (9) and (10), the time required to increase heating temperature of valuable constituent by a required quantity, can be calculated by the formula:

$$t_H = \frac{\Delta T \cdot c_r \rho_r}{f \pi \varepsilon_0 \varepsilon_r E_m^2 tg\delta_r}, \tag{11}$$

where

ΔT—required increase of heating temperature of valuable constituent (K);

$t_H$—heating time of the controlled lump in field of microwave electromagnetic radiation (s);

$c_r$—heat capacity of valuable constituent (J/K kg);

$\rho_r$—density of valuable constituent (kg/m$^3$).

During the heating time tH the valuable constituent in feedstock lump will be heated up to the temperature:

$$U_O = \frac{f \pi \varepsilon_0 \varepsilon_r E_m^2 \cdot tg\delta_r}{c_r \rho_r} \cdot t_H(K), \tag{12}$$

where $U_O$—heating temperature of valuable constituent in field of microwave electromagnetic radiation for the time $t_H$(K);

$c_r$—heat capacity of valuable constituent (J/K kg);

$\rho_r$—density of valuable constituent (kg/m$^3$).

The worthless material component in the feedstock lump will be heated up to the temperature:

$$T_O = \frac{f \pi \varepsilon_0 \varepsilon E_m^2 \cdot tg\delta}{c\rho} \cdot t_H(K), \tag{13}$$

where $T_O$—heating temperature of worthless material in field of microwave electromagnetic radiation for the time $t_H$ (K);

c—heat capacity of worthless material (J/K kg);

ρ—density of worthless material (kg/m$^3$).

∈—relative permittivity of worthless material tgδ—tangent of dielectric loss of worthless material.

Upon the completion of electromagnetic field effect, the heat exchanging process between valuable constituent and worthless material is described by the combined equations with initial conditions Uo and To:

$$\begin{cases} m_r c_r \dfrac{dU}{dt} = S_O k_r (T - U), \\ mc \dfrac{dT}{dt} = S_O k (U - T), \end{cases} \tag{14}$$

where $m_r$—weight of valuable constituent in the controlled lump (kg);

m—weight of worthless material in the controlled lump (kg);

dU/dt—speed of temperature change of valuable constituent after heating (K/s);

dT/dt—speed of temperature change of worthless material after heating (K/s);

U—current temperature of valuable constituent (K);

T—current temperature of worthless material (K);

$S_O$—heat exchange area between valuable constituent and worthless material is calculated by the formula.

Heat exchange area between valuable constituent and worthless material is calculated by the formula:

$$S_O = \frac{6m_r}{a\rho_r}(m^2),$$

where

α —particle size of valuable constituent (m);

k—heat emission coefficient of worthless material (W/K·m$^2$);

$k_r$—heat emission coefficient of valuable constituent (W/K·m$^2$).

The combined differential equations of heat exchange between valuable constituent and worthless material in the lump are solved as follows:

$$U(t) = A_0 e^{p_0 t} - \frac{mk_r c}{m_r k c_r} A_1 e^{p_1 t}, \tag{15}$$

$$T(t) = A_0 e^{p_0 t} + A_1 \cdot e^{p_1 t}, \tag{16}$$

where $A_0, A_1$,—constant coefficients are calculated by the formulas:

$$A_0 = \frac{mk_r c T_O + m_r k c_r U_O}{m_r k c_r + mk_r c}(K). \tag{17}$$

$$A_1 = \frac{m_r k c_r (T_O - U_O)}{m_r k c_r + mk_r c}(K). \tag{18}$$

The characteristic equation:

$$p \cdot \left( p + \frac{6km_r}{ac\rho_r m} + \frac{6k_r}{ac_r \rho_r} \right) = 0. \tag{19}$$

The roots of the characteristic equation $P_0$, $P_1$ $$p_0 = 0; \tag{20}$$

$$p_1 = -\frac{6}{a\rho_r} \cdot \left( \frac{m_r k}{mc} + \frac{k_r}{c_r} \right) \left( \frac{1}{s} \right), \tag{21}$$

Finally, the solution of the combined differential equations (14) will be:

$$U(t) = A_0 - \frac{mk_r c}{m_r k c_r} A_1 e^{p_1 t}, \tag{22}$$

$$T(t) = A_0 + A_1 \cdot e^{p_1 t}. \tag{23}$$

Figure 4:
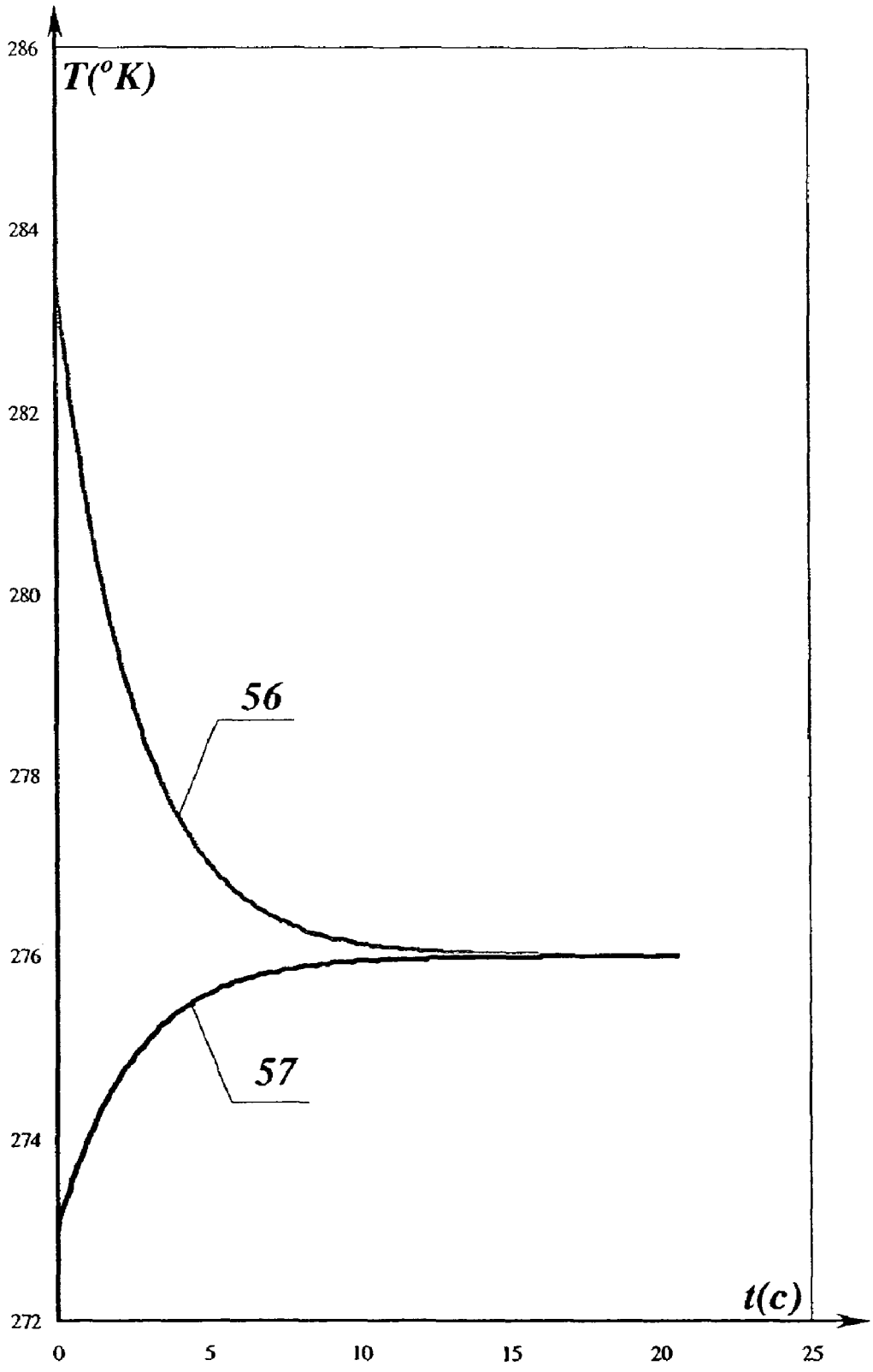
FIG. 4 is a time-temperature difference diagram representing heat exchange processes within a two-constituent lump with a heterogeneous distribution of the constituents throughout the lump.

The chart of temperature behavior in time of valuable constituent U(t) (curve 56) and worthless material T(t) (curve 57) at heat exchange process in a lump with heterogeneous distribution of components in its volume is presented in FIG. 4.

The preset value of temperature of heated lump will be given by:

$$T_U = A_0 = \frac{U_o + \frac{m}{m_r} \cdot \frac{k_r c}{k c_r} \cdot T_o}{1 + \frac{m}{m_r} \cdot \frac{k_r c}{k c_r}} (K), \tag{24}$$

where $T_U$—temperature of the controlled lump after completion of heat exchanging processes between components of the lump (steady state heating temperature of the controlled lump) (K).

Considering the fact that at balanced heat exchange $k=k_r$, we will solve equation (24) as respects $m/m_r$ and we will have:

$$\frac{m}{m_r} = \frac{(U_O - T_U)c_r}{(T_U - T_O)c}.$$

At known ratio $m/m_r$ weight fraction of component in the lump is found from the expression:

$$Q = \frac{1}{\frac{m}{m_r} + 1}.$$

Substituting value of the ratio $m/m_r$ into the given expression we will get an expression on the basis of which quantity of valuable constituent in the lump is defined:

$$Q = \frac{(T_U - T_O)c}{U_O c_r - T_U(c_r - c) - T_O c} \cdot 100\%, \tag{25}$$

where

Q—weight fraction of valuable constituent in the controlled lump (%).

To define steady state value of the lump temperature, the temperature is to be controlled by the thermographic system in a certain time period after the lump was heated. The time period is defined by duration of heat exchange transition process between valuable constituent and worthless material. The delay time between the completion of microwave energy radiation and the moment of steady state temperature control of the lump is calculated by the formula:

$$\Delta t_k = \frac{4}{|p_1|} = \frac{a\rho_r c_r (U_O - T_{Unop})}{1{,}5 k_r (U_O - T_O)}, \tag{26}$$

where $$T_{Unop} = \frac{U_O c_r Q_{nop} + T_O c(1 - Q_{nop})}{c_r Q_{nop} + c(1 - Q_{nop})}, \tag{27}$$

where $\Delta t_k$—delay time of control;

$Q_{nop}$—threshold value of weight fraction of valuable constituent in the lump;

$T_{Unop}$—steady state temperature for a lump with threshold value of weight fraction of valuable constituent.

After weight fraction of valuable constituent is defined, the condition is to be checked:

$$Q > Q_{nop}.$$

Depending on the result obtained, a lump is fed into effective area of the apparatus which, at the command of the computing system, performs separation of the feedstock in accordance with quantitative indexes of valuable constituent content.

THE METHOD EMBODIMENT EXAMPLE 1

A lump comprising two main components—magnetite and quartzite—is subjected to microwave electromagnetic field effect for 1 second. The physical parameters of the lump under radiation and microwave field are presented in Table 1.

TABLE 1

| Parameters | Measurement units | Substance magnetite | Substance quartzite |
|---|---|---|---|
| Relative permittivity | — | 68 | 0.1 |
| Tangent of dielectric loss | — | 0.4 | 0.009 |
| Density | $kg/m^3$ | 4700 | 3720 |
| Heat capacity | J/(K · kg) | 600 | 920 |
| Heat emission coefficient | $W/(K \cdot m^2)$ | 10 | 10 |
| Heating temperature | K | 283.5173 | 273.0003 |
| Initial temperature | K | 273 | |
| Electric intensity of microwave field | V/m | 4000 | |
| Microwave field frequency | Hz | 2450000000 | |
| Heating time | s | 1 | |
| Particle size | m | 0.000075 | |

The value of steady state temperature of a lump with threshold content of valuable constituent 33% is calculated by expression (27):

$$\begin{aligned} T_{Unop} &= \frac{U_O c_r Q_{nop} + T_O c(1 - Q_{nop})}{c_r Q_{nop} + c(1 - Q_{nop})} \\ &= \frac{283{,}5173 \cdot 600 \cdot 0{,}33 + 273{,}0003 \cdot 920 \cdot (1 - 0{,}33)}{600 \cdot 0{,}33 + 920 \cdot (1 - 0{,}33)} \\ &= 275{,}5572\ K. \end{aligned}$$

At the end of control time $\Delta t_k$, which is given by expression (26):

$$\begin{aligned} \Delta t_k &= \frac{4}{|p_1|} \\ &= \frac{a\rho_r c_r (U_O - T_{Unop})}{1{,}5 k_r (U_O - T_O)} \\ &= \frac{0{,}000075 \cdot 4700 \cdot 600 \cdot (283{,}5173 - 275{,}5572)}{1{,}5 \cdot 10 \cdot (283{,}5173 - 273{,}0003)} \\ &\approx 11c. \end{aligned}$$

The steady state temperature of the lump is defined by the thermographic system. Let the steady state temperature equal Tu=275.9 K.

We calculate weight fraction of valuable constituent content in the lump by formula (25):

$$Q = \frac{(T_U - T_O)\cdot c}{U_O\cdot c_r - T_U\cdot(c_r - c) - T_O\cdot c} = \frac{(275{,}9 - 273{,}0003)\cdot 920\cdot 100\%}{283{,}5173\cdot 600 - 275{,}9\cdot(600 - 920) - 273{,}0003\cdot 920} = 36{,}87\%.$$

We check the condition: $Q>Q_{nop}$.

Depending on the valued obtained, we see that the condition is satisfied (36.87%>33%), and the controlled lump is to be related to technological stream of lumps with valuable constituent.

THE METHOD EMBODIMENT EXAMPLE 2

A lump comprising two main components—hematite and quartzite—undergoes microwave electromagnetic field effect for 2 seconds. The physical parameters of the lump under radiation and microwave field are presented in Table 2.

TABLE 2

| Parameters | Measurement units | Substance hematite | Substance quartzite |
|---|---|---|---|
| Relative permittivity | — | 48 | 6.8 |
| Tangent of dielectric loss | — | 0.2 | 0.009 |
| Density | kg/m$^3$ | 5100 | 2660 |
| Heat capacity | J/(K · kg) | 630 | 850 |
| Heat emission coefficient | W/(K · m$^2$) | 10 | 10 |
| Heating temperature | K | 279.5159 | 273.0590 |
| Initial temperature | K | 273 | |
| Electric intensity of microwave field | V/m | 4000 | |
| Microwave field frequency | Hz | 2450000000 | |
| Heating time | s | 2 | |
| Particle size | m | 0.000075 | |

The value of steady state temperature of a lump with threshold content of valuable constituent 42% is found from expression (27):

$$T_{Unop} = \frac{U_O c_r Q_{nop} + T_O c(1 - Q_{nop})}{c_r Q_{nop} + c(1 - Q_{nop})} = \frac{279{,}5159\cdot 630\cdot 0{,}42 + 273{,}059\cdot 850\cdot(1 - 0{,}42)}{630\cdot 0{,}42 + 850\cdot(1 - 0{,}42)} = 275{,}3142\ K.$$

At the end of control time $\Delta t_k$, which is found from expression (26):

$$\Delta t_k = \frac{4}{|p_1|} = \frac{a\rho_r c_r(U_O - T_{Unop})}{1{,}5k_r(U_O - T_O)} = \frac{0{,}000075\cdot 5100\cdot 630\cdot(279{,}5159 - 275{,}3142)}{1{,}5\cdot 10\cdot(279{,}5159 - 273{,}059)} \approx 10c,$$

The steady state temperature of the lump is defined by the thermographic system. Let the steady state temperature equal Tu=275.2 K.

We calculate weight fraction of valuable constituent content in the lump by formula (25):

$$Q = \frac{(T_U - T_O)\cdot c}{U_O\cdot c_r - T_U\cdot(c_r - c) - T_O\cdot c} = \frac{(275{,}2 - 273{,}059)\cdot 850\cdot 100\%}{279{,}5159\cdot 600 - 275{,}2\cdot(600 - 850) - 273{,}059\cdot 850} = 40{,}09\%.$$

We check the condition: $Q>Q_{nop}$.

Depending on the valued obtained, we see that the condition is not satisfied (40.09%<42%), and the controlled lump is to be related to technological stream of lumps with worthless material.

The proposed method can be used in technological processes of feedstock lump separation at concentration of ores of ferrous and non-ferrous metals, mining and chemical feedstock and secondary feedstock with certain granulometric composition of lumps.

The inner composition of lumps can be binary (consisting of two phases) or quasi binary and can present a heterogeneous matrix system or a heterogeneous system of a statistic mixture type, with isotropic (quasi isotropic) or anisotropic macro structure.

The proposed method can be used at initial stages in concentration technologies (preliminary concentration) and preparation of lumpy feedstock for further separation, for example, for preliminary separation of lumpy feedstock crushed completely under conditions of underground mining of minerals directly at the mining site (at a face), for preliminary lump separation of feedstock at processing man-caused waste material, and also at final stages of concentration in those technologies where the final product of concentration is lump material with preset physical-chemical properties (for example, blast-furnace lumps, open-hearth lumps, etc.).

The second method can be embodied by the example of concentration of metal-containing feedstock, ores of ferrous and non-ferrous metals. The proposed method provides a feedstock separation which is performed in two streams: one stream comprises the lumps whose valuable constituent content is more than a preset value and another stream comprises the lumps whose valuable constituent content is less than a preset value. The feedstock subjected to separation can be the feedstock obtained directly after sloughing in the process of mining as well as the feedstocks in the form of rock weight which were subjected to additional ragging up to preset dimensions of a medium lump, and the feedstock of man-caused origin.

The feedstock moves from a proportioning loader onto the conveyer. The computing device via the output interface forms a control signal to the arrangement for feeding lump onto the belt and a control signal to the conveyer electric drive control system.

The conveyer conveys the lump into a zone of microwave electromagnetic field heating. In the zone, a preset heating time and a required electromagnetic radiation power are produced at the command of the computing device.

After the controlled lump is heated in microwave electromagnetic field, the lump components are heated up to various temperatures owing to their various electric, magnetic and thermophysical properties.

Accepting medium temperature of the controlled lump heated in microwave electromagnetic field as a generalized parameter of a two-phase statistic mixture and knowing volume concentrations of phases in the controlled lump, medium temperature of the controlled lump can be defined by the expression:

$$Tc = \frac{(3v-1)U_O + [3(1-v)-1]T_O}{4} + \sqrt{\left\{\frac{(3v-1)U_O + [3(1-v)-1]T_O}{4}\right\}^2 + \frac{U_O T_O}{2}}, \quad (28)$$

where v—volume concentration factor of valuable constituent;

Tc—measured medium temperature of the controlled lump (K), $U_O$—heating temperature of valuable constituent (K);

$T_O$—heating temperature of worthless material (K);

Volume concentration factor for two-phase statistic mixture is defined by the expression:

$$v = \frac{m_r}{m_r + m\frac{\rho_r}{\rho}}, \quad (29)$$

where $m_r$—weight of valuable constituent phase in the controlled lump (kg)

m—weight of worthless material phase in the controlled lump (kg);

$\rho_r$—density of valuable constituent phase in the controlled lump (kg/m$^3$);

ρ—density of worthless material phase in the controlled lump (kg/m$^3$).

Solving formula (28) as respects V one will obtain the following formula:

$$v = \frac{2T_c - \frac{U_0 T_0}{T_c} - 2T_0 + U_0}{3(U_0 - T_0)}. \quad (30)$$

After measuring the heating temperature of valuable constituent and worthless material and the medium temperature of the controlled lump, volume concentration factor of valuable constituent in the controlled lump can be calculated by expression (30).

After the lump is heated in microwave electromagnetic field, the computing system forms a control signal for the electric drive to feed the lump into effective area of the thermographic facility. The output signals of the thermographic facility via the input interface proceed into the computing system. The computing system calculates the value of volume concentration factor of valuable constituent for the controlled lump in accordance with formula (30). Then the condition is checked:

$$V > V_{nop} \quad (31),$$

where $v_{\partial on}$—threshold value of volume concentration factor of valuable constituent.

The threshold value of volume concentration factor of valuable constituent is defined by the expression:

$$v_{nop} = \frac{2Tc_{nop} - \frac{U_O \cdot T_O}{Tc_{nop}} - 2T_O + U_O}{3(U_O - T_O)}, \quad (32)$$

where $Tc_{nop}$—mean value of the lump temperature with threshold value of valuable constituent weight fraction which is calculated by the formula:

$$Tc_{nop} = \frac{U_o + \frac{(1-Q_{nop})}{Q_{nop}} \cdot \frac{k_r c}{kc_r} \cdot T_o}{1 + \frac{(1+Q_{nop})}{Q_{nop}} \cdot \frac{k_r c}{kc_r}}. \quad (33)$$

When condition (31) is satisfied, that is, valuable constituent quantity in the controlled lump is equal or exceeds a threshold value, with a dwell necessary for feeding the lump into effective area of the separation device, the computing system via the output interface turns the separation device on. The separation device changes trajectory of drop of the lump with valuable constituent and separates the feedstock into two technological streams respectively: the one with valuable constituent content and the one without it.

THE METHOD EMBODIMENT EXAMPLE 1

A lump comprising two main components—magnetite and quartzite—undergoes microwave electromagnetic field effect for 1 second. The physical parameters of the lump under radiation and microwave field are presented in Table 3.

TABLE 3

| Parameters | Measurement units | Substance magnetite | Substance quartzite |
|---|---|---|---|
| Relative permittivity | — | 68 | 0.1 |
| Tangent of dielectric loss | — | 0.4 | 0.009 |
| Density | kg/m$^3$ | 4700 | 3720 |
| Heat capacity | J/(K · kg) | 600 | 920 |
| Heat emission coefficient | W/(K · m$^2$) | 10 | 10 |
| Heating temperature | K | 283.5173 | 273.0003 |
| Initial temperature | K | 273 | |
| Electric intensity of microwave field | V/m | 4000 | |
| Microwave field frequency | Hz | 2450000000 | |
| Heating time | s | 1 | |
| Particle size | m | 0.000075 | |

The medium temperature of the controlled lump with threshold content of valuable constituent equal $Q_{nop}$=33% is given by the formula (33):

$$Tc_{nop} = \frac{U_o + \frac{(1-Q_{nop})}{Q_{nop}} \cdot \frac{k_r c}{kc_r} \cdot T_o}{1 + \frac{(1-Q_{nop})}{Q_{nop}} \cdot \frac{k_r c}{kc_r}}$$

-continued $$= \frac{283{,}5173 + \frac{(1-0{,}33)}{0{,}33} \cdot \frac{10 \cdot 920}{10 \cdot 600} \cdot 273{,}0003}{1 + \frac{(1-0{,}33)}{0{,}33} \cdot \frac{10 \cdot 920}{10 \cdot 600}}$$

$$= 275{,}5572\ K.$$

The threshold value of volume concentration factor of valuable constituent $V_{nop}$ with the threshold value of valuable constituent 33% is defined by the expression (32):

$$v_{nop} = \frac{2Tc_{nop} - \frac{U_O T_O}{Tc_{nop}} - 2T_O + U_O}{3(U_O - T_O)}$$

$$= \frac{2 \cdot 275{,}5572 - \frac{283{,}5173 \cdot 273{,}0003}{275{,}5572} - 2 \cdot 273{,}0003 + 283{,}5173}{3 \cdot (283{,}5173 - 273{,}0003)}$$

$$= 0{,}24546483.$$

Upon completion of microwave radiation effect, by means of the thermographic system, the mean value Tc of temperature of the controlled lump is calculated. In the given example it is:

Tc=275.9 K.

By formula (30) one can calculate the value of volume concentration factor of valuable constituent V for the given controlled lump:

$$v = \frac{2T_C - \frac{U_O \cdot T_O}{T_C} - 2T_O + U_O}{3(U_O - T_O)}$$

$$= \frac{2 \cdot 275{,}9 - \frac{283{,}5173 \cdot 273{,}0003}{275{,}9} - 2 \cdot 273{,}0003 + 283{,}5173}{3 \cdot (283{,}5173 - 273{,}0003)}$$

$$= 0{,}27949039.$$

Then the condition is to be checked:

$V > v_{nop}$.

Depending on the data obtained, we can see that the condition is satisfied (0.27949039>0.24546483), and the controlled lump is to be related to technological stream of lumps with valuable constituent.

THE METHOD EMBODIMENT EXAMPLE 2

A lump comprising two main components—hematite and quartzite—undergoes microwave electromagnetic field effect for 2 seconds. The physical parameters of the lump under radiation and microwave field are presented in Table 4:

TABLE 4

| Parameters | Measurement units | Substance hematite | Substance quartzite |
|---|---|---|---|
| Relative permittivity | — | 48 | 6.8 |
| Tangent of dielectric loss | — | 0.2 | 0.009 |

TABLE 4-continued

| Parameters | Measurement units | Substance hematite | Substance quartzite |
|---|---|---|---|
| Density | $kg/m^3$ | 5100 | 2660 |
| Heat capacity | J/(K · kg) | 630 | 850 |
| Heat emission coefficient | $W/(K \cdot m^2)$ | 10 | 10 |
| Heating temperature | K | 279.5159 | 273.0590 |
| Initial temperature | K | 273 | |
| Electric intensity of microwave field | V/m | 4000 | |
| Microwave field frequency | Hz | 2450000000 | |
| Heating time | s | 2 | |
| Particle size | m | 0.000075 | |

The medium temperature of the controlled lump with threshold content of valuable constituent equal Qπop=42% is defined by expression (33):

$$Tc_{nop} = \frac{U_o + \frac{(1-Q_{nop})}{Q_{nop}} \cdot \frac{k_r c}{kc_r} \cdot T_o}{1 + \frac{(1-Q_{nop})}{Q_{nop}} \cdot \frac{k_r c}{kc_r}}$$

$$= \frac{279{,}5159 + \frac{(1-0{,}42)}{0{,}42} \cdot \frac{10 \cdot 850}{10 \cdot 630} \cdot 273{,}059}{1 + \frac{(1-0{,}33)}{0{,}33} \cdot \frac{10 \cdot 920}{10 \cdot 600}}$$

$$= 275{,}3142\ K.$$

The threshold value of volume concentration factor of valuable constituent $V_{nop}$ with the threshold value of valuable constituent 42% is given by expression (32):

$$v_{nop} = \frac{2Tc_{nop} - \frac{U_O T_O}{Tc_{nop}} - 2T_O + U_O}{3(U_O - T_O)}$$

$$= \frac{2 \cdot 275{,}3142 - \frac{279{,}5159 \cdot 273{,}059}{275{,}3142} - 2 \cdot 273{,}059 + 279{,}5159}{3 \cdot (279{,}5159 - 273{,}059)}$$

$$= 0{,}35103759.$$

Upon completion of microwave radiation effect, by means of the thermographic system, the mean value Tc of temperature of the controlled lump is calculated. In the given example it is:

Tc=275.2 K

By formula (30) one can calculate the value of volume concentration factor of valuable constituent V for the given controlled lump:

$$v = \frac{2T_c - \frac{U_O \cdot T_O}{T_c} - 2T_O + U_O}{3(U_O - T_O)}$$

$$= \frac{2 \cdot 275{,}2 - \frac{279{,}5 \cdot 273{,}1}{275{,}2} - 2 \cdot 273{,}1 + 279{,}5}{3 \cdot (279{,}5 - 273{,}1)}$$

$$= 0{,}33243976.$$

Then the condition is to be checked:

$$V>v_{nop}.$$

Depending on the data obtained, we can see that the condition is not satisfied (0.33243976<0.35103759), and the controlled lump is to be related to technological stream of lumps with worthless material.

The proposed method can be used in technological processes of feedstock lump separation at concentration of ores of ferrous and non-ferrous metals, mining and chemical feedstock and secondary feedstock with certain granulometric composition of lumps.

The inner composition of lumps can be binary (consisting of two phases) or quasi binary and can present a heterogeneous matrix system or a heterogeneous system of a statistic mixture type, with isotropic (quasi isotropic) or anisotropic macro structure.

The proposed method can be used at initial stages in concentration technologies (preliminary concentration) and preparation of lump feedstock for further separation, for example, for preliminary lump separation of feedstock crushed completely under conditions of underground mining of minerals directly at the mining site (at a face), for preliminary lump separation of the feedstock at processing of man-caused waste material, and also at final stages of concentration in those technologies where the final product of concentration is lump material with preset physical-chemical properties (for example, blast-furnace lumps, open-hearth lumps, etc.).

The third method can be embodied by the example of concentration of metal-containing feedstock, ores of ferrous and non-ferrous metals. The proposed method provides a feedstock separation which is performed in two streams: one stream comprises the lumps whose valuable constituent content is more than a preset value and another stream comprises the lumps whose valuable constituent content is less than a preset value. The feedstock subjected to separation can be the feedstock obtained directly after sloughing in the process of mining as well as the feedstock in the form of rock weight which were subjected to additional ragging up to preset dimensions of mean lump, and the feedstock of man-caused origin.

The feedstock moves from a proportioning loader onto the conveyer. The computing device via the output interface forms a control signal for a lump dosed feeding device onto the belt and a control signal for the conveyer electric drive control system. The conveyer conveys the lump into the zone of microwave electromagnetic field heating. In the zone, a required electromagnetic radiation power is produced at the command of the computing device.

The signal from the conveyer speed sensor goes via the input interface into the computing device. The computing device via the output interface forms such a control signal for the conveyer electric drive control system that provides the speed of the conveyer required to find a lump in the zone of radiation and heating with electromagnetic field during a preset time which is calculated by formula (11).

The required linear speed of the conveyer belt Vk can be calculated by the formula:

$$V_K = \frac{L_H}{t_H}\left(\frac{m}{s}\right), \tag{34}$$

where $L_H$—equivalent linear dimension of microwave electromagnetic field radiation zone in the line of the velocity vector of the conveyer belt (m);

$t_H$—required time of microwave electromagnetic field effect on the controlled lump, which is calculated by formula (11) (s).

A lump of feedstock comprising valuable constituent and worthless material is irradiated with microwave electromagnetic field.

Due to the microwave energy being absorbed by the lump substance, the lump medium temperature, for the heating time, will increase by the value found from the expression:

$$\Delta T_C = \frac{f\pi E_m^2 \varepsilon_0 \varepsilon_{cp} tg\delta_{cp}}{c_{cp}\rho_{cp}} \cdot t_H\,(^{O}K), \tag{35}$$

where $\rho_{cp}$—mean density of the lump substance (kg/m$^3$);

$c_{cp}$—mean specific heat of the lump substance (J/K·kg);

$\in_{cp}$—mean relative permittivity of the lump substance;

$tg\delta_{cp}$—mean value of tangent of dielectric loss of the lump substance.

The mean density of the lump substance is found from the expression:

$$\rho_{cp} = \frac{M}{V_\beta}\left(\frac{\text{kg}}{m^3}\right), \tag{36}$$

where

M—weight of the lump (kg);

$V_\beta$—volume of the lump (m$^3$).

Furthermore $$M=M_r+m_{(kg)},$$

where $m_r$—weight of valuable constituent in the lump (kg);

m—weight of worthless material in the lump (kg).

The lump volume will be $$V_\beta=v_r+v(m^3),$$

where $v_r$—volume of valuable constituent in the lump (m$^3$);

v—volume of worthless material in the lump (m$^3$).

The volumes of valuable constituent and worthless material in the lump can be evaluated through their weightes and densities:

$$v_r = \frac{m_r}{\rho_r}; \qquad v = \frac{m}{\rho}.$$

Considering all the above said, the mean density of the lump will be defined by the expression:

$$\rho_{cp} = \frac{\rho_r\rho\left(\frac{m_r}{m}+1\right)}{\rho\frac{m_r}{m}+\rho_r}\left(\frac{\text{kg}}{m^3}\right). \tag{37}$$

The mean heat capacity of the lump substance is defined by the expression:

$$c_{cp}M = c_r m_r + cm \tag{38}$$

whence $$c_{cp} = \frac{c_r m_r + cm}{m_r + m}\left(\frac{J}{\hat{E}\cdot \mathrm{kg}}\right).$$

The microwave electromagnetic field energy, spent on heating the unit volume of substance of the controlled lump per unit time, is defined by the expression:

$$P_{cp}=\pi f E_m^2 \in_0 \in_{cp} tg\delta_{cp}(W) \tag{39}.$$

The microwave electromagnetic field energy, spent on heating the whole volume of valuable constituent of the controlled lump per unit time, is defined by the expression:

$$P_r = \pi f E_m^2 \varepsilon_0 \varepsilon_r g\delta_r v_r = \pi f E_m^2 \varepsilon_0 \varepsilon_r tg\delta_r \frac{m_r}{\rho_r}(W).$$

The microwave electromagnetic field energy, spent on heating the whole volume of worthless material of the controlled lump per unit time, is given by:

$$P_o = \pi f E_m^2 \varepsilon_0 \varepsilon tg\delta v = \pi f E_m^2 \varepsilon_0 \varepsilon tg\delta \frac{m}{\rho}(W).$$

The microwave electromagnetic field energy, spent on heating the whole volume of substance of the controlled lump per unit time, is given by:

$$P = P_r + P_o = \pi f E_m^2 \varepsilon_0 \left(\varepsilon_r tg\delta_r \frac{m_r}{\rho_r} + \varepsilon tg\delta \frac{m}{\rho}\right)(W).$$

Then the microwave electromagnetic field energy, spent on heating the unit volume of substance of the controlled lump per unit time, is defined by the expression:

$$p_{cp} = \frac{P}{v_r + v} = \pi f E_m^2 \varepsilon_0 \cdot \frac{\varepsilon_r tg\,\delta_r \frac{m_r}{\rho_r} + \varepsilon tg\delta \frac{m}{\rho}}{\frac{m_r}{\rho_r} + \frac{m}{\rho}}(W); \tag{40}$$

or $$p_{cp} = \pi f E_m^2 \varepsilon_0 \cdot \frac{\varepsilon_r tg\delta_r \frac{m_r}{m}\rho + \varepsilon tg\delta \rho_r}{\frac{m_r}{m}\rho + \rho_r}(W).$$

Comparing expressions (39) and (40), we can assume that:

$$\varepsilon_{cp} tg\delta_{cp} = \frac{\varepsilon_r tg\delta_r \frac{m_r}{m}\rho + \varepsilon tg\delta \rho_r}{\frac{m_r}{m}\rho + \rho_r}. \tag{41}$$

Expression (41) is a loss coefficient of substance of the controlled lump, evaluated through loss factors of valuable constituent $\in_r tg\delta_r$ and worthless material $\in tg\delta$ and weight relationships of valuable constituent and worthless material $m_r/m$ the controlled lump.

Substituting expressions (37) and (41) for formula (35) and carrying out the transformations, we will obtain the expression for medium elevation of temperature of the controlled lump:

$$\Delta T_C = \pi f E_m^2 \varepsilon_0 t_H \cdot \frac{\varepsilon_r tg\delta_r \frac{m_r}{m}\rho + \varepsilon tg\delta \rho_r}{\rho_r \rho\left(c_r \frac{m_r}{m} + c\right)}. \tag{42}$$

Taking medium temperature of the controlled lump, which was preliminarily heated in microwave electromagnetic field, by expression (42) one can calculate the ratio mr/m—weight of valuable constituent to weight of worthless material in this lump.

Upon leaving the electromagnetic field radiation zone the lump goes into effective area of the thermographic system, wherein the medium temperature of the heated lump is defined by means of its heat radiation image fixation.

The output signals of the thermogphic facility via the input interface go into the computing device.

When controlling the temperature by the thermographic facility, the fixed image of heat radiation of the heated controlled lump presents a chart of heat points. Each point of the fixed image of heat radiation is in accord with a rather small (elementary) zone of the controlled lump. Therefore, the temperature in the elementary zone can be considered the same.

It follows from the above that the medium exceeding of temperature of the whole lump can be defined by the expression:

$$\Delta T_C = \frac{1}{\sum_{i=1}^{N} \Delta S_i} \cdot \sum_{i=1}^{N} \Delta T_i \cdot \Delta S_i,$$

where $\Delta S_i$—area of the elementary zone, corresponding to a point of the fixed image of heat radiation of the heated controlled lump;

$\Delta T_i$—temperature exceeding of a point of the fixed image of heat radiation of the heated controlled lump;

N—number of points of the fixed image of heat radiation of the heated controlled lump.

Or, if $\Delta S_i$ is in accord with equally small elementary zones of the controlled lump, the medium temperature of the whole lump can be defined by the expression:

$$\Delta T_C = \frac{1}{N} \cdot \sum_{i=1}^{N} \Delta T_i. \tag{43}$$

Having solved expression (42) as respects $m_r/m$ , we obtain:

$$\frac{m_r}{m} = \frac{\pi f E_m^2 t_H \varepsilon_0 \varepsilon tg\delta \rho_r - \Delta T_C \rho_r \rho c}{T_C \rho_r \rho c_r - \pi f E_m^2 t_H \varepsilon_0 \varepsilon_r tg\delta_r \rho}. \tag{44}$$

The content (weight fraction) of valuable constituent in the controlled lump is given by:

$$Q = \frac{\frac{m_r}{m}}{\frac{m_r}{m} + 1}. \quad (45)$$

Substituting expression (45) for expression (44) and having carried out the transformations, we will obtain the formula for defining weight fraction of valuable constituent in the controlled lump:

$$Q = \frac{\rho_r Ae}{\rho_r Ae - \rho Ae_r}, \quad (46)$$

where $Ae=\pi f E_m^2 \in_0 \in tg\delta t_H - \Delta T_C \rho c$—accessory parameter of worthless material;

$Ae_r=\pi f E_m^2 \in_0 \in_r tg\delta_r t_H - \Delta T_C \rho_r c_r$—accessory parameter of valuable constituent.

In practice, depending on certain properties of valuable constituent and worthless material and their relationships, parameters of the controlled lump, sensitivity and quick speed of the devices applied for controlling the temperature, choosing frequency and intensity of microwave electromagnetic field, radiation time, control tactics (one-point, two-point and multipoint control), we can achieve the required accuracy of feedstock lump separation in a stream.

When the condition $Q \geqq Q_{nop}$ is satisfied, with a dwell needed to feed a lump into the effective area, the computing device via the output interface turns the separation device effectors on. The effectors change the mechanical trajectory of the lump with valuable constituent, thus providing separation of the lumps into the streams containing and those not containing valuable constituent.

THE METHOD EMBODIMENT EXAMPLE 1

A lump comprising two main components—magnetite and quartzite—undergoes microwave electromagnetic field effect for 1 second. The physical parameters of the lump under radiation and microwave field are presented in Table 5.

TABLE 5

| Parameters | Measurement units | Substance magnetite | Substance quartzite |
|---|---|---|---|
| Relative permittivity | — | 68 | 0.1 |
| Tangent of dielectric loss | — | 0.4 | 0.009 |
| Density | kg/m$^3$ | 4700 | 3720 |
| Heat capacity | J/(K · kg) | 600 | 920 |
| Heat emission coefficient | W/(K · m$^2$) | 10 | 10 |
| Heating temperature | K | 283.5173 | 273.0003 |
| Initial temperature | K | 273 | |
| Electric intensity of microwave field | V/m | 4000 | |
| Microwave field frequency | Hz | 2450000000 | |
| Heating time | s | 1 | |
| Particle size | m | 0.000075 | |

Let the threshold value of valuable constituent equal $Q_{nop}$=33%.

The medium temperature of the lump is defined by the thermographic system.

Let the medium temperature of the controlled lump equal Tc=275.9 K. Therefore, the exceeding of heating temperature will be:

$$\Delta T_C = Tc - T_H = 275.9 - 273 = 2.9\ K,$$

where $T_H$ —initial temperature of the controlled lump (see Table 5).

The weight fraction of valuable constituent content in the lump is calculated by formula (46):

$$Q = \frac{\rho_r Ae}{\rho_r Ae - \rho Ae_r},$$

where $$\begin{aligned} Ae &= \pi f E_m^2 \varepsilon_0 \varepsilon tg\delta t_H - \Delta T_C \rho c \\ &= \pi \cdot 2{,}45 \cdot 10^9 \cdot 4000^2 \cdot 8{,}85419 \cdot 10^{-12} \cdot 0{,}1 \cdot \\ &\quad 0{,}009 \cdot 1 - 2{,}9 \cdot 3720 \cdot 920 \\ &= -9923978{,}643 - \\ &\quad \text{accessory parameter of worthless material;} \end{aligned}$$

$$\begin{aligned} Ae_r &= \pi f E_m^2 \varepsilon_0 \varepsilon_r tg\delta_r t_H - \Delta T_C \rho_r c_r \\ &= \pi \cdot 2{,}45 \cdot 10^9 \cdot 4000^2 \cdot 8{,}85419 \cdot 10^{-12} \cdot 0{,}1 \cdot \\ &\quad 0{,}009 \cdot 1 - 2{,}9 \cdot 3720 \cdot 920 \\ &= 21480799{,}89\ ; - \\ &\quad \text{accessory parameter of valuable constituent;} \end{aligned}$$

$$\begin{aligned} Q &= \frac{4700 \cdot (-9923978{,}64\ 3) \cdot 100\ \%}{4700 \cdot (-9923978{,}64\ 3) - 3720 \cdot (21480799{,}\ 8\ 9)} \\ &= 36{,}86\ \%. \end{aligned}$$

The condition is to be checked: $Q > Q_{nop}$.

Depending on the values obtained, we see that the condition is satisfied (36.86%>33%), and the controlled lump is to be related to technological stream of lumps with valuable constituent.

THE METHOD EMBODIMENT EXAMPLE 2

A lump comprising two main components—hematite and quartzite—undergoes microwave electromagnetic field effect for 2 seconds. The physical parameters of the lump under radiation and microwave field are presented in Table 6.

TABLE 6

| Parameters | Measurement units | Substance hematite | Substance quartzite |
|---|---|---|---|
| Relative permittivity | — | 48 | 6.8 |
| Tangent of dielectric loss | — | 0.2 | 0.009 |
| Density | kg/m$^3$ | 5100 | 2660 |
| Heat capacity | J/(K · kg) | 630 | 850 |
| Heat emission coefficient | W/(K · m$^2$) | 10 | 10 |
| Heating temperature | K | 279.5159 | 273.0590 |
| Initial temperature | K | 273 | |
| Electric intensity of microwave field | V/m | 4000 | |
| Microwave field frequency | Hz | 2450000000 | |
| Heating time | s | 2 | |
| Particle size | m | 0.000075 | |

Let the threshold value of valuable constituent equal $Q_{nop}$=33%.

The medium temperature of the lump is defined by the thermographic system. Let the medium temperature of the controlled lump equal Tc=275.2 K. Therefore, the exceeding of heating temperature will be:

$$\Delta T_C = T_c - T_H = 275.2 - 273 = 2.2\ K,$$

where $T_H$ —initial temperature of the controlled lump (see Table 6).

The weight fraction of valuable constituent content in the lump is calculated by formula (46):

$$Q = \frac{\rho_r Ae}{\rho_r Ae - \rho Ae_r},$$

where $$\begin{aligned} Ae &= \pi f E_m^2 \varepsilon_0 \varepsilon tg\delta t_H - \Delta T_C \rho c \\ &= \pi \cdot 2{,}45 \cdot 10^9 \cdot 4000^2 \cdot 8{,}8541878 \cdot 10^{-12} \cdot \\ &\quad 6{,}8 \cdot 0{,}009 \cdot 2 - 2{,}2 \cdot 2660 \cdot 850 \\ &= -4840735{,}4. - \end{aligned}$$

accessory parameter of worthless material;

$$\begin{aligned} Ae_r &= \pi f E_m^2 \varepsilon_0 \varepsilon_r tg\delta_r t_H - \Delta T_C \rho_r c_r \\ &= \pi \cdot 2{,}45 \cdot 10^9 \cdot 4000^2 \cdot 8{,}8541878 \cdot 10^{-12} \cdot \\ &\quad 48 \cdot 0{,}2 \cdot 2 - 2{,}2 \cdot 5100 \cdot 630 \\ &= 13867023{,}45. - \end{aligned}$$

accessory parameter of valuable constituent;

$$Q = \frac{5100 \cdot (-4840735{,}4) \cdot 100\,\%}{5100 \cdot (-4840735{,}4) - 2660 \cdot (13867023{,}4\ 5)} = 40{,}09\,\%.$$

The condition is to be checked: $Q > Q_{nop}$.

Depending on the values obtained, one can see that the condition is satisfied (40.09%<42%), and the controlled lump is to be related to technological stream of lumps with valuable constituent.

The proposed method can be used in technological processes of feedstock lump separation at concentration of ores of ferrous and non-ferrous metals, mining and chemical feedstock and secondary feedstock with certain granulometric composition of lumps.

The inner composition of lumps can be binary (consisting of two phases) or quasi binary and can present a heterogeneous matrix system or a heterogeneous system of a statistic mixture type, with isotropic (quasi isotropic) macrostructure.

The proposed method can be used at initial stages in concentration technologies (preliminary concentration) and preparation of lump feedstock for further separation, for example, for preliminary lump separation of feedstock crushed completely under conditions of underground mining of minerals directly at the mining site (at a face), for preliminary lump separation of feedstock at processing of man-caused waste material, and also at final stages of concentration in those technologies where the final product of concentration is lump material with preset physical-chemical properties (for example, blast-furnace lumps, open-hearth lumps, etc.).

The fourth method can be embodied by the example of concentration of metal-containing feedstock, ores of ferrous and non-ferrous metals. The proposed method provides a feedstock separation which is performed in two streams: one stream comprises the lumps whose valuable constituent content is more than a preset value and another stream comprises the lumps whose valuable constituent content is less than a preset value. The feedstock subjected to separation can be the feedstock obtained directly after sloughing in the process of mining as well as the feedstock in the form of rock weight which were subjected to additional ragging up to preset dimensions of mean lump, and the feedstock of man-caused origin.

The feedstock moves from a proportioning loader onto the conveyer. The computing device via the output interface forms a control signal for a lump dosed feeding device onto the belt and a control signal for control system of electric drive of the conveyer. The conveyer conveys the lump into a zone of microwave electromagnetic field heating. In the zone, a preset heating time and a required electromagnetic radiation power are produced at the command of the computing device.

The controlled lump is heated with microwave electromagnetic field frequency f, which is in accord with the condition of formula (8), the intensity Em, for the time tH, defined by expression (11). The frequency f, the intensity Em of microwave electromagnetic field and the time of microwave electromagnetic field effect tH can be chosen from other technical or technological conditions, too.

For the heating time the valuable constituent will be heated up to the temperature $U_O$, defined by expression (12), and the worthless material component will be heated up to the temperature $T_O$, defined by expression (13).

After completion of electromagnetic field effect the heat exchanging process between valuable constituent and worthless material is described by combined differential equations (14) with the initial conditions $U_O$ and $T_O$:

The combined differential equations for lump heating are solved as respects (16) as follows:

$$T(t) = A_0 + A_1 \cdot e^{p_1 t}.$$

Using expansion of exponential function into power series and having limited ourselves to terms of order N (for example, third order) we will solve the equations as follows:

$$T(t) = A_0 + A_1 + A_1 p_1 t + \frac{A_1 p_1^2}{2} t^2 + \frac{A_1 p_1^3}{6} t^3, \tag{47}$$

or $$T(t) = X_1 + X_2 t + X_3 t^2 + X_4 t^3, \tag{48}$$

where $A_0$, $A_1$, $P_1$,—constant coefficients are defined in accordance with expressions (17), (18) and (21). Or, presenting weight via corresponding volume and density of the component, we will obtain:

$$A_0 = T_O - A_1, \tag{49}$$

$$A_1 = \frac{T_O - U_O}{1 + \frac{c\rho k_r (V - v)}{c_r \rho_r k v}}, \tag{50}$$

$$p_1 = -\frac{6}{a} \cdot \left( \frac{kv}{c\rho(V - v)} + \frac{k_r}{c_r \rho_r} \right). \tag{51}$$

Since equation (48) comprises four components to be found, four combined equations (52) are written for four incongruous moments of time:

$$\begin{cases} T(t_1) = X_1 + X_2 \cdot t_1 + X_3 \cdot t_1^2 + X_4 \cdot t_1^3 \\ T(t_2) = X_1 + X_2 \cdot t_2 + X_3 \cdot t_2^2 + X_4 \cdot t_2^3 \\ T(t_3) = X_1 + X_2 \cdot t_3 + X_3 \cdot t_3^2 + X_4 \cdot t_3^3 \\ T(t_4) = X_1 + X_2 \cdot t_4 + X_3 \cdot t_4^2 + X_4 \cdot t_4^3 \end{cases}, \quad (52)$$

where $T(t_1)$, $T(t_2)$, $T(t_3)$, $T(t_4)$—medium temperature of the lump, defined at the moments of time $t_1$, $t_2$, $t_3$, $t_4$.

Having solved the combined equations (52) as respects $X_1$, $X_2$, $X_3$, $X_4$ and considering the fact that the ratio $$\frac{2X_3}{X_2} = p_1$$

and knowing the expression for the root of characteristic equation, we calculate the volume filling-coefficient of valuable constituent for the controlled lump;

$$Kv = \frac{c\rho(X_2 a c_r \rho_r + 3X_2 k_r)}{c\rho(X_3 a c_r \rho_r + 3X_2 k_r) - 3X_2 c_r \rho_r k} \quad (53)$$

and the condition is to be checked:

$$Kv > Kv_{nop} \quad (54),$$

where $Kv_{\partial on}$—threshold value of the volume filling coefficient of valuable constituent.

Depending on the result obtained, the lump is fed into effective area of the apparatus which, at the command of the computing system, performs separation of the feedstock in accordance with quantitative indexes of valuable constituent content.

Figure 6:
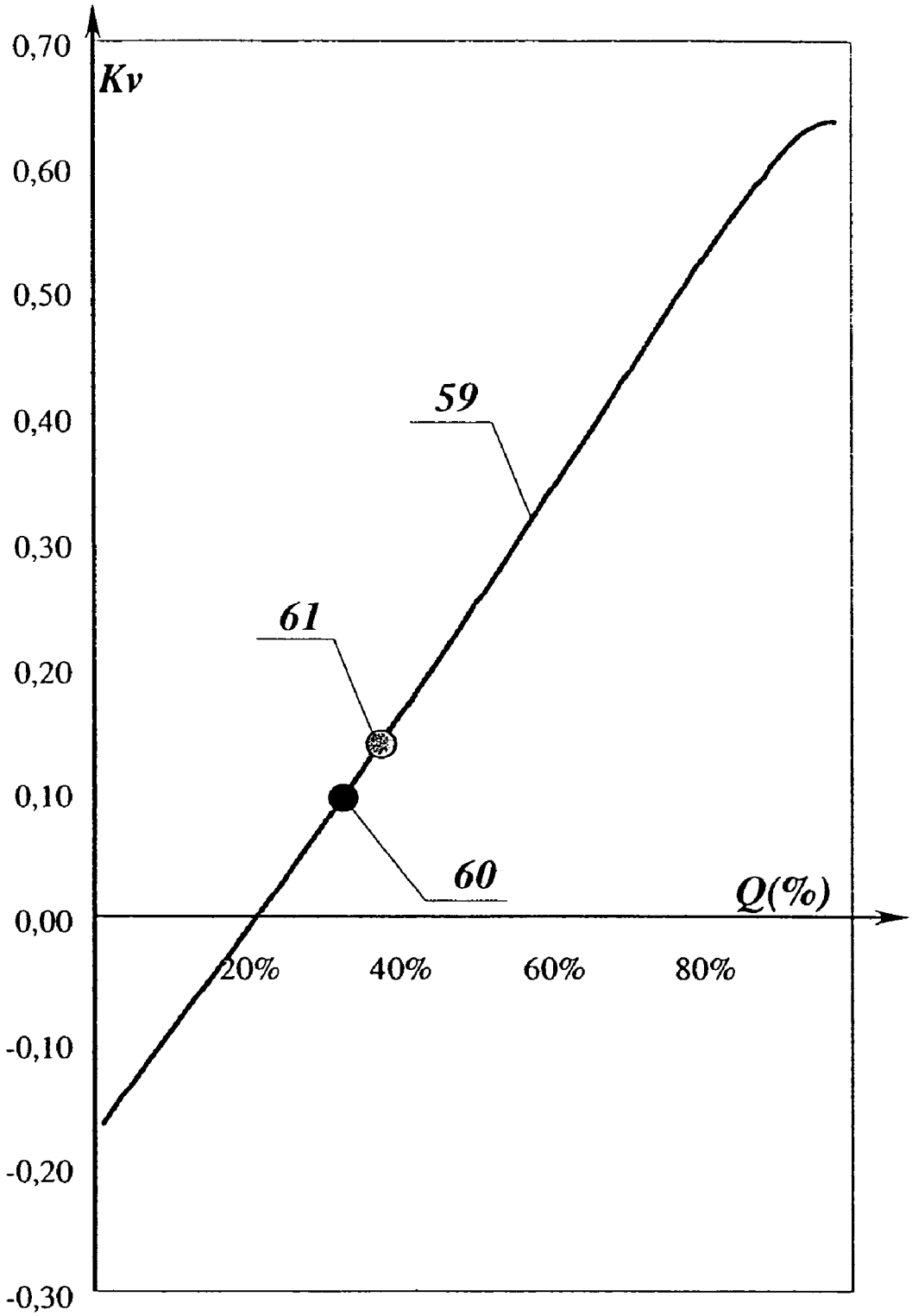
FIG. 6 is a graph of a coefficient of volumetric content of a valuable constituent as a function of the weight fraction of the valuable constituent in the target lump.

The chart of dependence of volume filling coefficient of valuable constituent from weight fraction of valuable constituent in the controlled lump is presented in FIG. 6, line 59. The point 60 corresponds to the threshold value of volume filling coefficient of valuable constituent, and the point 61 corresponds to the current value of volume filling coefficient of valuable constituent.

THE METHOD EMBODIMENT EXAMPLE 1

A lump comprising two main components—magnetite and quartzite—undergoes microwave electromagnetic field effect for 1 second. The physical parameters of the lump under radiation and microwave field are presented in Table 7.

TABLE 7

| Parameters | Measurement units | Substance magnetite | Substance quartzite |
|---|---|---|---|
| Relative permittivity | — | 68 | 0.1 |
| Tangent of dielectric loss | — | 0.4 | 0.009 |
| Density | kg/m³ | 4700 | 3720 |

TABLE 7-continued

| Parameters | Measurement units | Substance magnetite | Substance quartzite |
|---|---|---|---|
| Heat capacity | J/(K · kg) | 600 | 920 |
| Heat emission coefficient | W/(K · m²) | 10 | 10 |
| Heating temperature | K | 283.5173 | 273.0003 |
| Initial temperature | K | 273 | |
| Electric intensity of microwave field | V/m | 4000 | |
| Microwave field frequency | Hz | 2450000000 | |
| Heating time | s | 1 | |
| Particle size | m | 0.000075 | |

For the threshold value of valuable constituent content equal $Q_{nop}$=33% we define:

$$\text{Weight of valuable constituent-}m_r = M \cdot Q_{\hat{i}i\partial} = 1 \cdot 0,33 = 0,33 \text{ kg.}$$

$$\text{Weight of worthless material-}m = M \cdot (1 - Q_{\hat{i}i\partial}) = 1 \cdot (1 - 0,33) = 0,67 \text{ kg.}$$

$$Ao_{nop} = \frac{mk_r cT_O + m_r kc_r U_O}{mk_r c + m_r kc_r} = \frac{0,67 \cdot 10 \cdot 920 \cdot 273,0003 + 0,33 \cdot 10 \cdot 600 \cdot 283,5173}{0,67 \cdot 10 \cdot 920 + 0,33 \cdot 10 \cdot 600} = 275,557224K;$$

$$A_{1nop} = \frac{m_r kc_r (T_O - U_O)}{mk_r c + m_r kc_r} = \frac{0,33 \cdot 10 \cdot 600 \cdot (273,0003 - 283,5173)}{0,67 \cdot 10 \cdot 920 + 0,33 \cdot 10 \cdot 600} = -2,556937K;$$

$$p1_{nop} = -\frac{6}{a\rho_r} \cdot \left(\frac{m_r k}{mc} + \frac{k_r}{c_r}\right) = -\frac{6}{0,000075 \cdot 4700} \cdot \left(\frac{0,33 \cdot 10}{0,67 \cdot 920} + \frac{10}{600}\right) = -0,374814\frac{1}{s}.$$

In some four certain moments of time $t_1$, $t_2$, $t_3$, $t_4$ after microwave radiation effect is completed, the mean values of $T(t_i)$ of the temperature of the controlled lump are defined by the thermographic system. In the given example they are:

moments of control time—$t_1$=1s; $t_2$=2s; $t_3$=3s; $t_4$=4s;

mean values of temperature—$T(t_1)$=273.98 K; $T(t_2)$=274.64 K; $T(t_3)$=275.09 K; $T(t_4)$=275.39 K.

For the same moments of time $t_1$, $t_2$, $t_3$, $t_4$ we calculate values of temperatures of the lump with the threshold value of valuable constituent content:

$$T_{nop}(t_1) = Ao_{nop} + A_{1nop} e^{p1_{nop} \cdot t_1} = 275,5572239 - 2,55693713 \cdot e^{-0,37481418 \cdot 1} = 273,80K;$$

-continued $$T_{nop}(t_2) = Ao_{nop} + A_{1nop}e^{p\,l_{nop}\cdot t_2}$$
$$= 275,5572239 - 2,55693713\cdot e^{-0,37481418\cdot 2}$$
$$= 274,35K;$$
$$T_{nop}(t_3) = Ao_{nop} + A_{1nop}e^{p\,l_{nop}\cdot t_3}$$
$$= 275,5572239 - 2,55693713\cdot e^{-0,37481418\cdot 3}$$
$$= 274,72K;$$
$$T_{nop}(t_4) = Ao_{nop} + A_{1nop}e^{p\,l_{nop}\cdot t_4}$$
$$= 275,5572239 - 2,55693713\cdot e^{-0,37481418\cdot 4}$$
$$= 274,99K.$$

Depending on the values $T_{nop}$ ($t_i$) obtained, we write the combined equations:

$$\begin{cases} T_{nop}(t_1) = X_{1nop} + X_{2nop}\cdot t_1 + X_{3nop}\cdot t_1^2 + X_{4nop}\cdot t_1^3 \\ T_{nop}(t_2) = X_{1nop} + X_{2nop}\cdot t_2 + X_{3nop}\cdot t_2^2 + X_{4nop}\cdot t_2^3 \\ T_{nop}(t_3) = X_{1nop} + X_{2nop}\cdot t_3 + X_{3nop}\cdot t_3^2 + X_{4nop}\cdot t_3^3 \\ T_{nop}(t_4) = X_{1nop} + X_{2nop}\cdot t_4 + X_{3nop}\cdot t_4^2 + X_{4nop}\cdot t_4^3 \end{cases},$$

Having solved the equations, we define the values $X_{2nop}$ and $X_{3nop}$.

$$X_{2nop}=0.90545;\ X_{3nop}=-0.13955$$

and expression (53) we will calculate the threshold value of the volume filling coefficient of valuable constituent:

$$Kv_{nop} = \frac{c\rho(X_{3nop}ac_r\rho_r + 3X_{2nop}k_r)}{c\rho(X_{3nop}ac_r\rho_r + 3X_{2nop}k_r) - 3X_{2nop}c_r\rho_r k},$$

$$\Theta 1_{nop} = c\rho(X_{3nop}ac_r\rho_r + 3X_{2nop}k_r)$$
$$= 920\cdot 3720\cdot((-0,13955)\cdot 7,5\cdot 10^{-5}\cdot 600\cdot 4700 + 3\cdot 0,90545\cdot 10)$$
$$= -8049246,77;$$
$$\Theta 2_{nop} = 3X_{2nop}c_r\rho_r k$$
$$= 3\cdot 0,90545\cdot 600\cdot 4700\cdot 10$$
$$= 76601070,9;$$
$$Kv_{nop} = \frac{\Theta 1_{nop}}{\Theta 1_{nop} - \Theta 2_{nop}}$$
$$= \frac{-8049246,77}{-8049246,77 - 76601070,9}$$
$$= 0,095088.$$

For the calculated values T($t_i$) we write the combined equations:

$$\begin{cases} T(t_1) = X_1 + X_2\cdot t_1 + X_3\cdot t_1^2 + X_4\cdot t_1^3 \\ T(t_2) = X_1 + X_2\cdot t_2 + X_3\cdot t_2^2 + X_4\cdot t_2^3 \\ T(t_3) = X_1 + X_2\cdot t_3 + X_3\cdot t_3^2 + X_4\cdot t_3^3 \\ T(t_4) = X_1 + X_2\cdot t_4 + X_3\cdot t_4^2 + X_4\cdot t_4^3 \end{cases},$$

having solved the equations, one will define the values $X_2$ and $X_3$ $$X_2=1.11727;\ X_3=-0.17949;$$

and expression (53) we will calculate the value of the volume filling coefficient of valuable constituent of the controlled lump:

$$Kv = \frac{c\rho(X_3ac_r\rho_r + 3X_2k_r)}{c\rho(X_3ac_r\rho_r + 3X_2k_r) - 3X_2c_r\rho_r k},$$

$$\Theta 1 = c\rho(X_3ac_r\rho_r + 3X_2k_r)$$
$$= 920\cdot 3720\cdot((-0,17949)\cdot 7,5\cdot 10^{-5}\cdot 600\cdot 4700 + 3\cdot 1,11727\cdot 10)$$
$$= -15212483,49;$$
$$\Theta 2 = 3X_2c_r\rho_r k$$
$$= 3\cdot 1,11727256113,855072\cdot 600\cdot 4700\cdot 10$$
$$= 1172139091,2;$$
$$Kv = \frac{\Theta 1}{\Theta 1 - \Theta 2}$$
$$= \frac{-15212483,0}{-15212483,0 - 94521258,0}$$
$$= 0,138631.$$

The condition is to be checked: $Kv>Kv_{nop}$.

Depending on the values obtained, we see that the condition is satisfied (0.138631>0.3095088), and the controlled lump is to be related to the technological stream of lumps with valuable constituent.

THE METHOD EMBODIMENT EXAMPLE 2

A lump comprising two main components—hematite and quartzite—undergoes microwave electromagnetic field effect for 2 seconds. The physical parameters of the lump under radiation and microwave field are presented in Table 8.

TABLE 8

| Parameters | Measurement units | Substance hematite | Substance quartzite |
|---|---|---|---|
| Relative permittivity | — | 48 | 6.8 |
| Tangent of dielectric loss | — | 0.2 | 0.009 |
| Density | kg/m³ | 5100 | 2660 |
| Heat capacity | J/(K · kg) | 630 | 850 |
| Heat emission coefficient | W/(K · m²) | 10 | 10 |
| Heating temperature | K | 279.5159 | 273.0590 |
| Initial temperature | K | 273 | |
| Electric intensity of microwave field | V/m | 4000 | |
| Microwave field frequency | Hz | 2450000000 | |
| Heating time | s | 2 | |
| Particle size | m | 0.000075 | |

For the threshold value of valuable constituent content equal $Q_{nop}$=42% we calculate:

$$\text{Weight of valuable constituent} - m_r = M\cdot Q_{\hat{i}\hat{i}\hat{o}}$$
$$= 1.0,42$$
$$= 0,42\ \text{kg}.$$

-continued $$\text{Weight of worthless material} - m = M \cdot (1 - Q_{\hat{i}\hat{i}\hat{o}}) = 1 \cdot (1 - 0,58) = 0,58 \text{ kg.}$$

$$Ao_{nop} = \frac{mk_rT_O + m_rkc_rU_O}{mk_rc + m_rkc_r} = \frac{0,58 \cdot 10 \cdot 850 \cdot 273,059 + 0,42 \cdot 10 \cdot 630 \cdot 279,5159}{0,58 \cdot 10 \cdot 850 + 0,42 \cdot 10 \cdot 630} = 275,314165K;$$

$$A_{1nop} = \frac{m_rkc_r(T_O - U_O)}{mk_rc + m_rkc_r} = \frac{0,42 \cdot 10 \cdot 630 \cdot (273,059 - 279,5159)}{0,58 \cdot 10 \cdot 850 + 0,42 \cdot 10 \cdot 630} = -2,255136K;$$

$$p1_{nop} = -\frac{6}{a\rho_r} \cdot \left(\frac{m_rk}{mc} + \frac{k_r}{c_r}\right) = -\frac{6}{0,000075 \cdot 5100} \cdot \left(\frac{0,42 \cdot 10}{0,58 \cdot 850} + \frac{10}{630}\right) = -0,382624\frac{1}{s}.$$

In some four certain moments of time $t_1$, $t_2$, $t_3$, $t_4$ after microwave radiation effect is completed, the mean values of $T(t_i)$ of the temperature of the controlled lump are defined by the thermographic system. In the given example they are:

moments of control time—$t_1$=1s; $t_2$=2s; $t_3$=3s; $t_4$=4s.

mean values of temperature—$T(t_1)$=273.67 K; $T(t_2)$=274.10 K; $T(t_3)$=274.40 K; $T(t_4)$=274.60 K.

For the same moments of time $t_1$, $t_2$, $t_3$, $t_4$ we calculate values of temperatures of the lump with the threshold content of valuable constituent:

$$T_{nop}(t_1) = Ao_{nop} + A_{1nop}e^{p1_{nop} \cdot t_1} = 275,3141651 - 2,255136074 \cdot e^{-0,382624089 \cdot 1} = 273,78K;$$

$$T_{nop}(t_2) = Ao_{nop} + A_{1nop}e^{p1_{nop} \cdot t_2} = 275,3141651 - 2,255136074 \cdot e^{-0,382624089 \cdot 2} = 274,27K;$$

$$T_{nop}(t_3) = Ao_{nop} + A_{1nop}e^{p1_{nop} \cdot t_3} = 275,3141651 - 2,255136074 \cdot e^{-0,382624089 \cdot 3} = 274,60K;$$

$$T_{nop}(t_4) = Ao_{nop} + A_{1nop}e^{p1_{nop} \cdot t_4} = 275,3141651 - 2,255136074 \cdot e^{-0,382624089 \cdot 4} = 274,83K.$$

Depending on the values $T_{nop}(t_i)$ obtained, we write the combined equations:

$$\begin{cases} T_{nop}(t_1) = X_{1nop} + X_{2nop} \cdot t_1 + X_{3nop} \cdot t_1^2 + X_{4nop} \cdot t_1^3 \\ T_{nop}(t_2) = X_{1nop} + X_{2nop} \cdot t_2 + X_{3nop} \cdot t_2^2 + X_{4nop} \cdot t_2^3 \\ T_{nop}(t_3) = X_{1nop} + X_{2nop} \cdot t_3 + X_{3nop} \cdot t_3^2 + X_{4nop} \cdot t_3^3 \\ T_{nop}(t_4) = X_{1nop} + X_{2nop} \cdot t_4 + X_{3nop} \cdot t_4^2 + X_{4nop} \cdot t_4^3 \end{cases},$$

having solved the equations, we define the values $X_{2nop}$ and $X_{3nop}$ $$X_{2nop}=0.812867;\ X_{3nop}=-0.127169;$$

and by formula (53) we will calculate the threshold value of the volume filling coefficient of valuable constituent:

$$Kv_{nop} = \frac{c\rho(X_{3nop}ac_r\rho_r + 3X_{2nop}k_r)}{c\rho(X_{3nop}ac_r\rho_r + 3X_{2nop}k_r) - 3X_{2nop}c_r\rho_rk};$$

$$\Theta 1_{nop} = c\rho(X_{3nop}ac_r\rho_r + 3X_{2nop}k_r) = 850 \cdot 2660 \cdot ((-0,127169) \cdot 7,5 \cdot 10^{-5} \cdot 630 \cdot 5100 + 3 \cdot 0,812867 \cdot 10) = -14150810,03;$$

$$\Theta 2_{nop} = 3X_{2nop}c_r\rho_rk = 3 \cdot 0,812867 \cdot 630 \cdot 5100 \cdot 10 = 78352249,63;$$

$$Kv_{nop} = \frac{\Theta 1_{nop}}{\Theta 1_{nop} - \Theta 2_{nop}} = \frac{-14150810,0}{-14150810,0 - 78352249,0} = 0,152977.$$

For the calculated values $T(t_i)$ we write the set of equations:

$$\begin{cases} T(t_1) = X_1 + X_2 \cdot t_1 + X_3 \cdot t_1^2 + X_4 \cdot t_1^3 \\ T(t_2) = X_1 + X_2 \cdot t_2 + X_3 \cdot t_2^2 + X_4 \cdot t_2^3 \\ T(t_3) = X_1 + X_2 \cdot t_3 + X_3 \cdot t_3^2 + X_4 \cdot t_3^3 \\ T(t_4) = X_1 + X_2 \cdot t_4 + X_3 \cdot t_4^2 + X_4 \cdot t_4^3 \end{cases},$$

having solved the equations, we will define the values $X_2$ and $X_3$ $$X_2=0.693136;\ X_3=-0.104161;$$

and by formula (53) we will calculate the value of the volume filling coefficient of valuable constituent of the controlled lump:

$$Kv = \frac{c\rho(X_3ac_r\rho_r + 3X_2k_r)}{c\rho(X_3ac_r\rho_r + 3X_2k_r) - 3X_2c_r\rho_rk};$$

-continued $$\begin{aligned}\Theta 1 &= c\rho(X_3 a c_r \rho_r + 3X_2 k_r)\\ &= 850\cdot 2660\cdot((-0,104161)\cdot 7,5\cdot 10^{-5}\cdot 630\cdot 5100 + \\ &\quad 3\cdot 0,693136\cdot 10)\\ &= -9736303,468;\\ \Theta 2 &= 3X_2 c_r \rho_r k\\ &= 3\cdot 0,693136\cdot 630\cdot 5100\cdot 10\\ &= 66811414,71;\\ Kv &= \frac{\Theta 1}{\Theta 1-\Theta 2}\\ &= \frac{-9736303,468}{-9736303,468-66811414,71}\\ &= 0,127193.\end{aligned}$$

The condition is to be checked: $Kv > Kv_{nop}$.

Depending on the values obtained, we see that the condition is not satisfied (0.127193<0.152977), and the controlled lump is to be related to the technological stream of lumps with worthless material.

The proposed method can be used in technological processes of feedstock lump separation at concentration of ores of ferrous and non-ferrous metals, mining and chemical feedstock and secondary feedstock with certain granulometric composition of lumps.

The inner composition of lumps can be binary (consisting of two phases) or quasi binary and can present a heterogeneous matrix system or a heterogeneous system of a statistic mixture type, with isotropic (quasi isotropic) or anisotropic macro structure.

The proposed method can be used at initial stages in concentration technologies (preliminary concentration) and preparation of lump feedstock for further separation, for example, for preliminary lump separation of feedstock crushed completely under conditions of underground mining of minerals directly at the mining site (at a face), for preliminary lump separation of feedstock at processing of man-caused waste material, and also at final stages of concentration in those technologies where the final product of concentration is lump material with preset physical-chemical properties (for example, blast-furnace lumps, open-hearth lumps, etc.).

The fifth method can be embodied by the example of concentrating metal-containing feedstock, ores of ferrous and non-ferrous metals. The proposed method provides a feedstock separation which is performed in two streams: one stream comprises the lumps whose valuable constituent content is more than a preset value and another stream comprises the lumps whose valuable constituent content is less than a preset value. The feedstock subjected to separation can be the feedstock obtained directly after sloughing in the process of mining as well as the feedstock in the form of rock weight which were subjected to additional ragging up to preset dimensions of mean lump, and the feedstock of man-caused origin.

The feedstock moves from a proportioning loader onto the conveyer. The computing device via the output interface and the control system forms a control signal for a lump dosed feeding device onto the belt and a control signal for the conveyer electric drive control system. The conveyer conveys the lump into a zone of microwave electromagnetic field heating. In the zone, the required electromagnetic radiation power is produced at the command of the computing device.

The controlled lump is heated with microwave electromagnetic field frequency f, the intensity $E_m$, for the time $t_H$.

Upon completion of electromagnetic field effect the heat exchanging process between valuable constituent and worthless material is described by combined differential equations (14) with the initial conditions Uo and To.

The combined differential equations (14) are solved by expressions (15) and (16).

Figure 5:
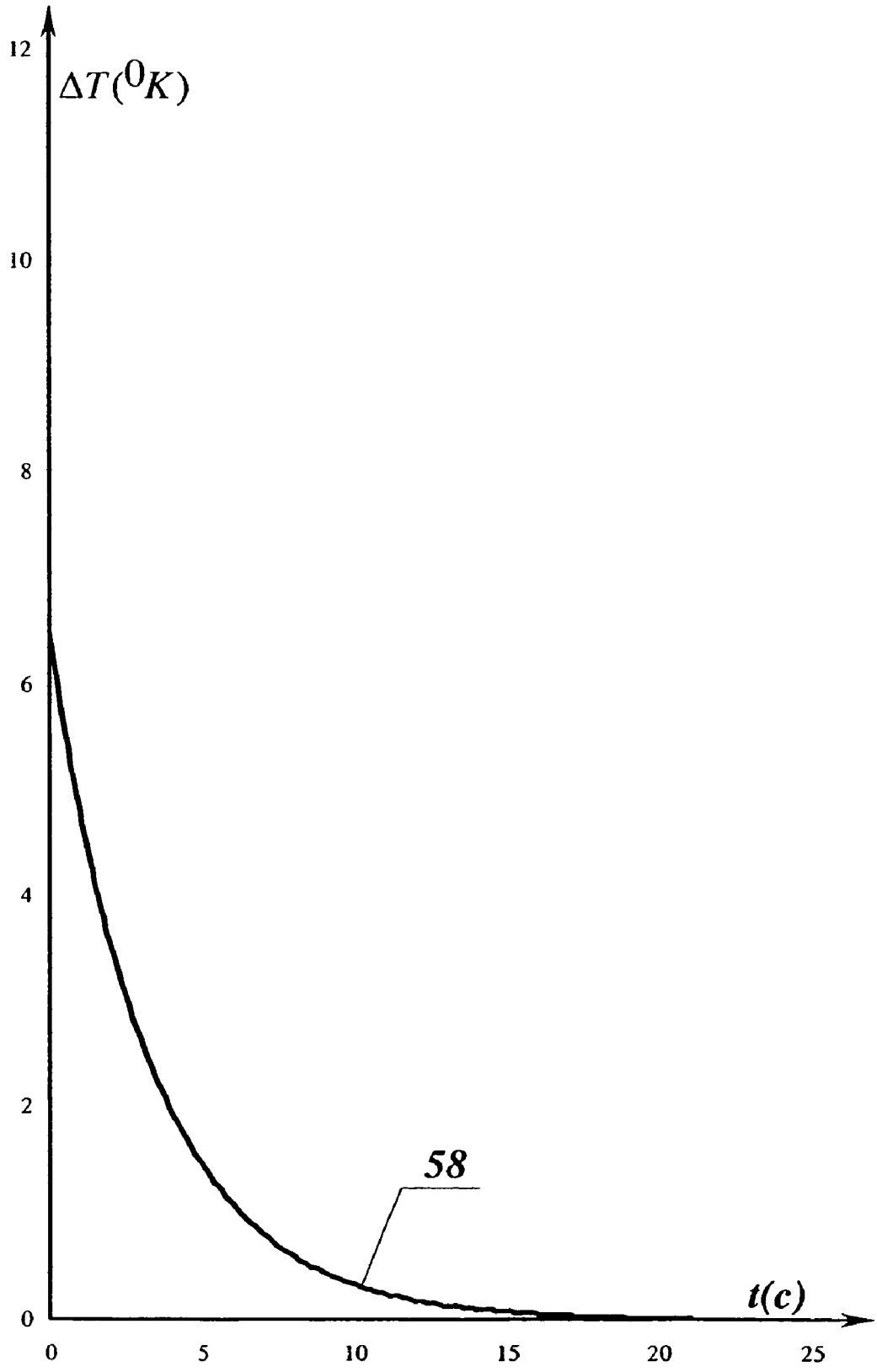
FIG. 5 is a time-temperature diagram representing heat exchange processes within a two-constituent lump with a heterogeneous distribution of the constituents throughout the lump.

Subtracting expression (16) from expression (15), left and right sides respectively, and substituting with the values of the coefficient $A_1$ (expression (18) and the root of the characteristic equation P1 (expression (21), we will achieve the dependence in time (see FIG. 5, line 58) of the exceeding of temperature of valuable constituent over worthless material temperature of the controlled lump after the completion of electromagnetic field effect. The dependence in time will be defined by the expression:

$$\Delta T(t) = (U_O - T_O)e^{-\frac{6}{a\rho_r}\cdot\left(\frac{m_r k}{mc}+\frac{k_r}{c_r}\right)t}. \tag{55}$$

Having solved the equation (55) as respects $m_r/m$ we will achieve the expression for defining values of $m_r/m$ at any moment of time upon the completion of electromagnetic field effect on the controlled lump:

$$\frac{m_r}{m} = \frac{cc_r\ln\left(\frac{U_O - T_O}{\Delta T(t)}\right) - \frac{6}{a\rho_r}ck_r t}{\frac{6}{a\rho_r}c_r k t}. \tag{56}$$

After registration of the thermal image of the controlled lump by the thermal imager which is made at the moment of time $t_K$, the maximum $T_{max}$ ($t_K$) and the minimum $T_{min}$ ($t_K$) temperature of the controlled lump are defined depending on the moment of time tK.

At the moment of time $t_K$ the value $m_r/m$ in the controlled lump can be defined by the expression:

$$\frac{m_r}{m} = \frac{cc_r\ln\left(\frac{U_O - T_O}{\Delta T(t_K)}\right) - \frac{6}{a\rho_r}ck_r t_K}{\frac{6}{a\rho_r}c_r k t_K}, \tag{57}$$

where $$\Delta T(t_K) = T_{\max}(t_K) - T_{\min}(t_K). \tag{58}$$

At known ratio $m_r/m$ weight fraction of valuable constituent in the lump is given by:

$$Q = \frac{\frac{m_r}{m}}{\frac{m_r}{m}+1}. \tag{59}$$

Substituting the value of expressions (57) and (58) into expression (59) we will obtain the expression on the basis of which quantity of valuable constituent in the lump will be calculated:

$$Q = \frac{cc_r \ln\left(\frac{U_O - T_O}{\Delta T(t_K)}\right) - \frac{6k_r c t_K}{a\rho_r}}{cc_r \ln\left(\frac{U_O - T_O}{\Delta T(t_K)}\right) + \frac{6(kc_r - k_r c)t_K}{a\rho_r}}. \quad (60)$$

After weight fraction of valuable constituent is defined, we check the condition:

$Q > Q_{nop}$.

In accordance with the result achieved, the lump is fed into effective area of the apparatus which, at the command of the computing device, separates the feedstock depending on quantitative indexes of the valuable constituent content.

THE METHOD EMBODIMENT EXAMPLE 1

A lump comprising two main components—magnetite and quartzite—undergoes microwave electromagnetic field effect for 1 second. The physical parameters of the lump under radiation and microwave field are presented in Table 9.

TABLE 9

| Parameters | Measurement units | Substance magnetite | Substance quartzite |
|---|---|---|---|
| Relative permittivity | — | 68 | 0.1 |
| Tangent of dielectric loss | — | 0.4 | 0.009 |
| Density | kg/m³ | 4700 | 3720 |
| Heat capacity | J/(K · kg) | 600 | 920 |
| Heat emission coefficient | W/(K · m²) | 10 | 10 |
| Heating temperature | K | 283.5173 | 273.0003 |
| Initial temperature | K | 273 | |
| Electric intensity of microwave field | V/m | 4000 | |
| Microwave field frequency | Hz | 2450000000 | |
| Heating time | s | 1 | |
| Particle size | m | 0.000075 | |

Let the threshold value of valuable constituent content equal $Q_{nop}$=33%

At the end of a certain known period of time, for example $t_k$=2 seconds, the thermal image of the controlled lump is registered by the thermographic system. The differential between maximum and minimum temperatures $\Delta T(t_k)$ is defined on the basis of the thermal image.

Let the differential between maximum and minimum temperatures $\Delta T(t_k)$=4.8 K.

By formula (60) weight fraction of valuable constituent content can be calculated:

$$Q = \frac{cc_r \ln\left(\frac{U_O - T_O}{\Delta T(t_K)}\right) - \frac{6 \cdot k_r \cdot c \cdot t_K}{a \cdot \rho_r}}{cc_r \ln\left(\frac{U_O - T_O}{\Delta T(t_K)}\right) + \frac{6 \cdot (k \cdot c_r - k_r \cdot c) \cdot t_K}{a \cdot \rho_r}}$$

$$= \frac{600 \cdot 920 \cdot \ln\left(\frac{283{,}5173 - 273{,}0003}{4,\ 8}\right) - \frac{6 \cdot 10 \cdot 920 \cdot 2}{0,\ 000075 \cdot 4700}}{600 \cdot 920 \cdot \ln\left(\frac{283{,}5173 - 273{,}0003}{4,\ 8}\right) + \frac{6 \cdot (10 \cdot 600 - 10 \cdot 920) \cdot 2}{0,\ 000075 \cdot 4700}} \cdot 100\%$$

$$= 36{,}97\%.$$

The condition is to be checked: $Q > Q_{nop}$.

Depending on the values achieved we see that the condition is satisfied (36.97%>33%), and the controlled lump is to be related to the technological stream of lumps with valuable constituent.

THE METHOD EMBODIMENT EXAMPLE 2

A lump comprising two main components—hematite and quartzite—undergoes microwave electromagnetic field effect for 2 seconds. The physical parameters of the lump under radiation and microwave field are presented in Table 10:

TABLE 10

| Parameters | Measurement units | Substance hematite | Substance quartzite |
|---|---|---|---|
| Relative permittivity | — | 48 | 6.8 |
| Tangent of dielectric loss | — | 0.2 | 0.009 |
| Density | kg/m³ | 5100 | 2660 |
| Heat capacity | J/(K · kg) | 630 | 850 |
| Heat emission coefficient | W/(K · m²) | 10 | 10 |
| Heating temperature | K | 279.5159 | 273.0590 |
| Initial temperature | K | 273 | |
| Electric intensity of microwave field | V/m | 4000 | |
| Microwave field frequency | Hz | 2450000000 | |
| Heating time | s | 2 | |
| Particle size | m | 0.000075 | |

The threshold value of valuable constituent is equal $Q_{nop}$=42%.

At the end of a known period of time, for example $t_k$=2 seconds, the thermal image of the controlled lump is registered by the thermographic system. The differential between maximum and minimum temperatures $\Delta T(t_k)$ is defined on the basis of the thermal image.

Let the differential between maximum and minimum temperatures $\Delta T(t_k)$=3.1K.

By formula (60) weight fraction of valuable constituent content can be calculated:

$$Q = \frac{cc_r \ln\left(\frac{U_O - T_O}{\Delta T(t_K)}\right) - \frac{6 \cdot k_r \cdot c \cdot t_K}{a \cdot \rho_r}}{cc_r \ln\left(\frac{U_O - T_O}{\Delta T(t_K)}\right) + \frac{6 \cdot (k \cdot c_r - k_r \cdot c) \cdot t_K}{a \cdot \rho_r}}$$

$$= \frac{630 \cdot 850 \cdot \ln\left(\frac{279{,}5159 - 273{,}059}{3,\ 1}\right) - \frac{6 \cdot 10 \cdot 850 \cdot 2}{0{,}000075 \cdot 5100}}{630 \cdot 850 \cdot \ln\left(\frac{279{,}5159 - 273{,}059}{3,\ 1}\right) + \frac{6 \cdot (10 \cdot 630 - 10 \cdot 850) \cdot 2}{0{,}000075 \cdot 5100}} \cdot 100\%$$

$$= 38{,}98\%.$$

The condition is to be checked: $Q > Q_{nop}$.

Depending on the values achieved we see that the condition is satisfied (38.98%<42%), and the controlled lump is to be related to the technological stream of lumps with valuable constituent.

The proposed method can be used in technological processes of feedstock lump separation at concentration of ores of ferrous and non-ferrous metals, mining and chemical feedstock and secondary feedstock with certain granulometric composition of lumps.

The inner composition of lumps can be binary (consisting of two phases) or quasi binary and can present a heterogeneous matrix system or a heterogeneous system of a statistic mixture type, with isotropic (quasi isotropic) or anisotropic macrostructure.

The proposed method can be used at initial stages in concentration technologies (preliminary concentration) and preparation of lump feedstock for further separation, for example, for preliminary lump separation of feedstock crushed completely under conditions of underground mining of minerals directly at the mining site (at a face), for preliminary lump separation of feedstock at processing of man-caused waste material, and also at final stages of concentration in those technologies where the final product of concentration is lump material with preset physical-chemical properties (for example, blast-furnace lumps, open-hearth lumps, etc.).

The first apparatus comprises an arrangement for feeding feedstock lumps 1, which consists (see FIG. 1 and FIG. 2) of a receiving bin 2, a screw feeder 3 with an electric drive 4, a feeder electric drive control system 5, and a rolling handler 6, a conveyor 9 with an electric drive 7, and conveyer electric drive control system 8; a microwave generator 10 with a control system 11, and a microwave heating chamber 26; a thermographic system 12 with heat-sensing devices 13; an input interface 14, a computing device 15, an output interface 16; a control pulse shaper 17, an solenoid-operated pneumatic valve 18, a time delay unit 19, a comparator 20; a narrow-beam light emitter 21, photodetector 22, a position handler 23; a separation device with a worthless material receiving bin 24 and a concentrate receiving bin 25. In addition, the outlet of the thermagraphic system 12 is connected with the first inlet of the input interface 14. The outlet of the input interface 14 is connected via the computing device 15 with the inlet of the output interface 16; the first outlet of the output interface 16 is connected with the first inlet of the comparator 20. The second inlet of the comparator 20 is connected with outlet of the photodetector 22 of the light radiator 21, and the outlet via the time delay unit 19 and the control pulse shaper 17 is connected to the inlet of the solenoid-operated pneumatic valve 18. The second outlet of output interface 16 is connected with the feeder electric drive control system 5 of the feedstock dosed feeding device. The third outlet of output interface 16 is connected via the control system with the inlet of microwave generator 10, which is attached to the microwave heating chamber. The fourth outlet of output interface 16 is connected with control system for the conveyer 8 of the electric drive 7 of the conveyer 9. On the roller of the conveyer 9 a position sensor 23 is installed which is connected with the second inlet of input interface 14.

The feedstock lumps consisting of valuable constituent and worthless material are radiated in microwave heating chamber with electromagnetic field frequency f, which is calculated by formula (8), with the intensity Em, for the time tH. During the heating time the valuable constituent in feedstock lump will be heated up to the temperature Uo, calculated by expression (12), and the worthless material will be heated up to the temperature To, calculated by expression (13).

Upon completion of electromagnetic field action, the heat exchanging processes between valuable constituents and worthless material will be directed at temperature leveling between valuable constituent and worthless material. The character of this process and its parameters will be defined by properties of valuable constituent and worthless material and relationship of their weight fractions.

Measuring parameters of the heat exchange process by the heat-sensing devices and the thermographic system, we can define weight fraction of valuable constituent in the controlled lump and compare it with the threshold value.

According to the result of the comparison, an appropriate separation effect on the controlled lump is formed.

THE APPARATUS EMBODIMENT EXAMPLE 1

The diagram of the first apparatus is presented in FIG. 1. As an embodiment variant the apparatus works as follows.

The computing device 15 via output interface 16 and conveyer electric drive control system 8 turns on the electric drive 7 of the conveyer 9. Upon achieving the preset speed of the belt, which is calculated depending on data coming via input interface 14 from the position sensor of the conveyer 23, the computing device 15 via output interface 16 and feeder electric drive control system 5 turns on the electric drive 4 of the feeder 3. By means of the feeder 3 the feedstock lumps 1 from the receiving bin 2 are fed onto the rolling handler 6. Moving on the rolling handler, the feedstock lumps are distributed on the surface of the rolling handler in one layer. This provides a one-layer feeding of the conveyer 9. Simultaneously, the computing device 15 via output interface 16 and the control system for microwave facility 11 turns on the microwave generator 10 and presets a required microwave radiation power.

The microwave energy from the microwave generator comes into the microwave heating chamber 26, which is placed on the conveyer 9 so that the feedstock lumps which move on the conveyer 9, enter the microwave heating chamber 26 and are exposed to microwave electromagnetic field effect. While in the microwave heating chamber 26, the feedstock lumps are heated up to the temperature whose value is specified by properties of the lump material and by the time of microwave electromagnetic field effect. The time of effect of microwave electromagnetic field on the feedstock lumps in the given apparatus can be defined by the expression:

$$\Delta t_H = \frac{l_H}{V_K}(\mathrm{s}),$$

where $\Delta t_H$—time of effect of microwave electromagnetic field on the controlled lumps (seconds);

$l_H$—length of the zone of microwave electromagnetic field effect on the controlled lumps according to the velocity vector of the belt (m);

$V_K$—speed of the belt (n/s).

In a certain not zero time $t_K$ tK upon completion of microwave electromagnetic field effect on the feedstock lump, it goes into a control zone of the heat-sensing devices 13. In the control zone, a thermal image of the controlled lump is fixed by the thermographic system 12. The output signal of the thermographic facility 12 via input interface 14 goes into the computing device 15 which defines weight fraction of valuable constituent in the controlled lump according to formula (60):

$$Q = \frac{cc_r \ln\left(\frac{U_O - T_O}{\Delta T(t_K)}\right) - \frac{6 \cdot k_r \cdot c \cdot t_K}{a \cdot \rho_r}}{cc_r \ln\left(\frac{U_O - T_O}{\Delta T(t_K)}\right) + \frac{6 \cdot (k \cdot c_r - k_r \cdot c) \cdot t_K}{a \cdot \rho_r}}$$

the condition is checked: $Q \geqq Q_{nop}$.

The control time $t_K$ in the given apparatus can be given by:

$$t_K = \frac{l_K}{V_K}(\mathrm{s}),$$

where $l_K$—distance from the end of the microwave electromagnetic field effective area till the area of fixing of the thermal image by the thermographic facility (m).

At exceeding of weight fraction of valuable constituent in the controlled lump of a preset threshold value, after the lump reaches a drop point from the conveyer 9, which is controlled by the position sensor 23, the computing device 15 with a dwell a little less than the time of dropping of the lump from the drop point from the conveyer till the point of intersection of a narrow beam of the narrow-beam light emitter 21, via the output interface 16, gives an enable signal to the comparator 20. The moment the lump intersects the narrow beam of the narrow-beam light emitter 21, a signal is formed at the outlet of the photodetector 22, which is given to the second inlet of the comparator 20. When signals at both inlets of the comparator 20 coincide, a signal is formed at the outlet of the comparator. With a dwell defined by the flyby time of the lump from the narrow-beam light emitter 21 till the axis of the solenoid-operated pneumatic valve 18 and preset by the time delay unit 19, via the control pulse shaper 17, the signal opens the solenoid-operated pneumatic valve 18. At opening of the solenoid-operated pneumatic valve an air stream is formed at the nozzle outlet. Under the effect of the air stream the mechanical trajectory of the lump is modified so that it drops into the concentrate receiving bin 25.

If weight fraction of valuable constituent in the controlled lump does not exceed the preset threshold value, the computing device 15 does not give an enable signal to the comparator 20 and when the lump intersects the narrow beam of the narrow-beam light emitter 21, a signal does not appear at its outlet. As a result, the solenoid-operated pneumatic valve does not open and the lump does not change its mechanical trajectory, thus allowing drop of the lump into the worthless material receiving bin 24.

THE APPARATUS EMBODIMENT EXAMPLE 2

Figure 2:
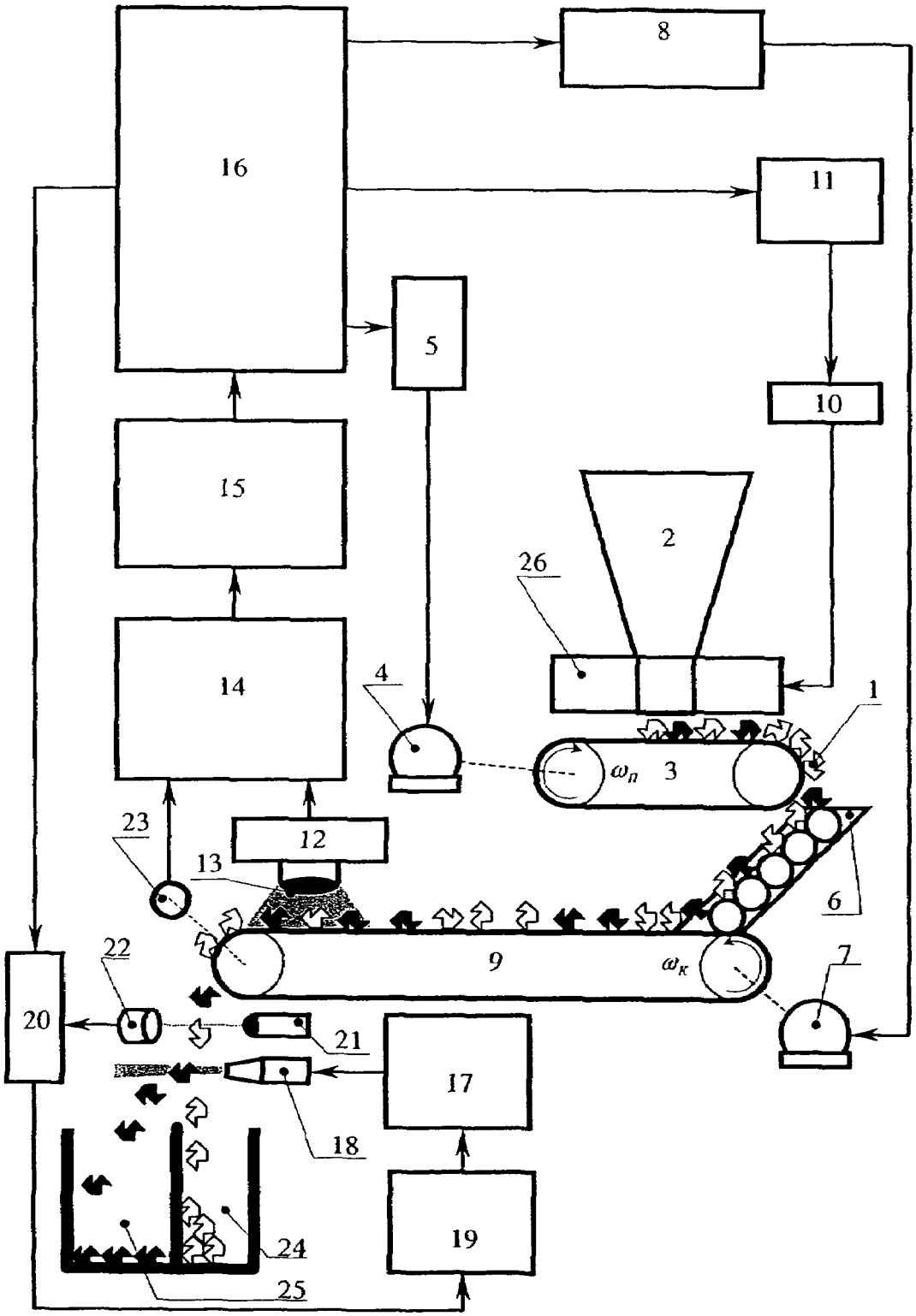
FIG. 2 is a schematic representation of a first apparatus for thermographically separating lumpy feedstock, another embodiment.

The diagram of the first apparatus is presented in FIG. 2. As an embodiment variant the apparatus works as follows.

The computing device 15 via output interface 16 and for the conveyer electric drive control system 8 turns on the electric drive 7 of the conveyer 9. Simultaneously, the computing device 15 via output interface 16 and the microwave facility control system 11 turns on the microwave generator 10 and presets the required microwave radiation power. The microwave energy from the microwave generator comes into the microwave heating chamber 26, which is placed at the outlet (chute) of the receiving bin in such a way that the feedstock lumps form the receiving bin, which move on the conveyer 9, go into microwave heating chamber 26 and are subjected to microwave electromagnetic field effect.

Upon achieving the preset speed of the belt, which is calculated depending on data coming via input interface 14 from the position sensor of the conveyer 23, the computing device 15 via output interface 16 and feeder electric drive control system 5 turns on the electric drive 4 of the feeder 3, by means of which the feedstock lumps, heated by the microwave field, from the outlet (chute) of the receiving bin 2 are fed onto the rolling handler 6. Moving on the rolling handler, the heated feedstock lumps are distributed on the surface of the rolling handler in one layer. This provides a one-layer feeding of the conveyer 9.

Being in the microwave heating chamber 26, the feedstock lumps are heated up to the temperature whose value is specified by properties of the lump material and by the time of microwave electromagnetic field effect. The time of effect of microwave electromagnetic field effect on the feedstock lumps in the given apparatus can be defined by the expression:

$$t_H = \frac{l_T}{V_T}(\mathrm{s}),$$

where $t_H$—time of effect of microwave electromagnetic field effect on the controlled lumps (s);

$l_T$—length of the area of microwave electromagnetic field effect on feedstock lumps in the outlet (chute) of the receiving bin (m);

$V_T$—mean speed of moving of feedstock lumps in the outlet (chute) of the receiving bin (m/s).

Some time after completion of microwave electromagnetic field effect on the feedstock lump, it goes into heat-sensing devices control zone 13, wherein the thermal image of the controlled lump is fixed by the thermographic system 12. According to the thermal image the medium temperature of the controlled lump is defined.

The value of the time interval between the moment of cease of microwave electromagnetic field effect till the moment of fixing of the thermal image must not be less than ˆtK, defined by expression (26).

The output signal of the thermographic facility 12 via input interface 14 goes into the computing device 15 which defines weight fraction of valuable constituent in the controlled lump according to formula (25):

$$Q = \frac{(T_U - T_O)c}{U_O c_r - T_U(c_r - c) - T_O c}$$

the condition is checked: $Q \geqq Q_{nop}$.

At exceeding of valuable constituent weight fraction in the controlled lump of a preset threshold value, after the lump reaches a drop point from the conveyer 9, which is controlled by the position sensor 23, the computing device 15 with a dwell a little less than the time of dropping of the lump from the drop point from the conveyer till the point of intersection of a narrow beam of the narrow-beam light emitter 21, via the output interface 16 gives an enable signal to the comparator 20. The moment the lump intersects the narrow beam of the narrow-beam light emitter 21, a signal is formed at the outlet of the photodetector 22, which is given to the second inlet of the comparator 20. When signals at both inlets of the comparator 20 coincide, a signal is formed at the outlet of the comparator. With a dwell defined by the flyby time of the lump from the narrow-beam light emitter 21 till the axis of the solenoid-operated pneumatic valve 18 and preset by the time delay unit 19, via the control pulse shaper 17, the signal opens the solenoid-operated pneumatic valve 18. At opening of the solenoid-operated pneumatic valve an air stream is formed at the nozzle outlet. Under the effect of the air stream the mechanical trajectory of the lump is modified so that it drops into the concentrate receiving bin 25.

If weight fraction of valuable constituent in the controlled lump does not exceed the preset threshold value, the computing device 15 does not give an enable signal to the comparator 20 and when the lump intersects the narrow beam of the narrow-beam light emitter 21, a signal does not appear at its outlet. As a result, the solenoid-operated pneumatic valve does not open and the lump does not change its mechanical trajectory, thus allowing drop of the lump into the worthless material receiving bin 24.

The proposed apparatus comprises separate units of general industrial application and special equipment, which is released by industry and available at the market.

To manufacture the present apparatus there is no need in development and release of new equipment specially designed for manufacturing of the present apparatus. To manufacture the proposed apparatus there is need in engineering logical design of the apparatus operation, software for the computing device and coupling of units of general industrial and special function.

Figure 3:
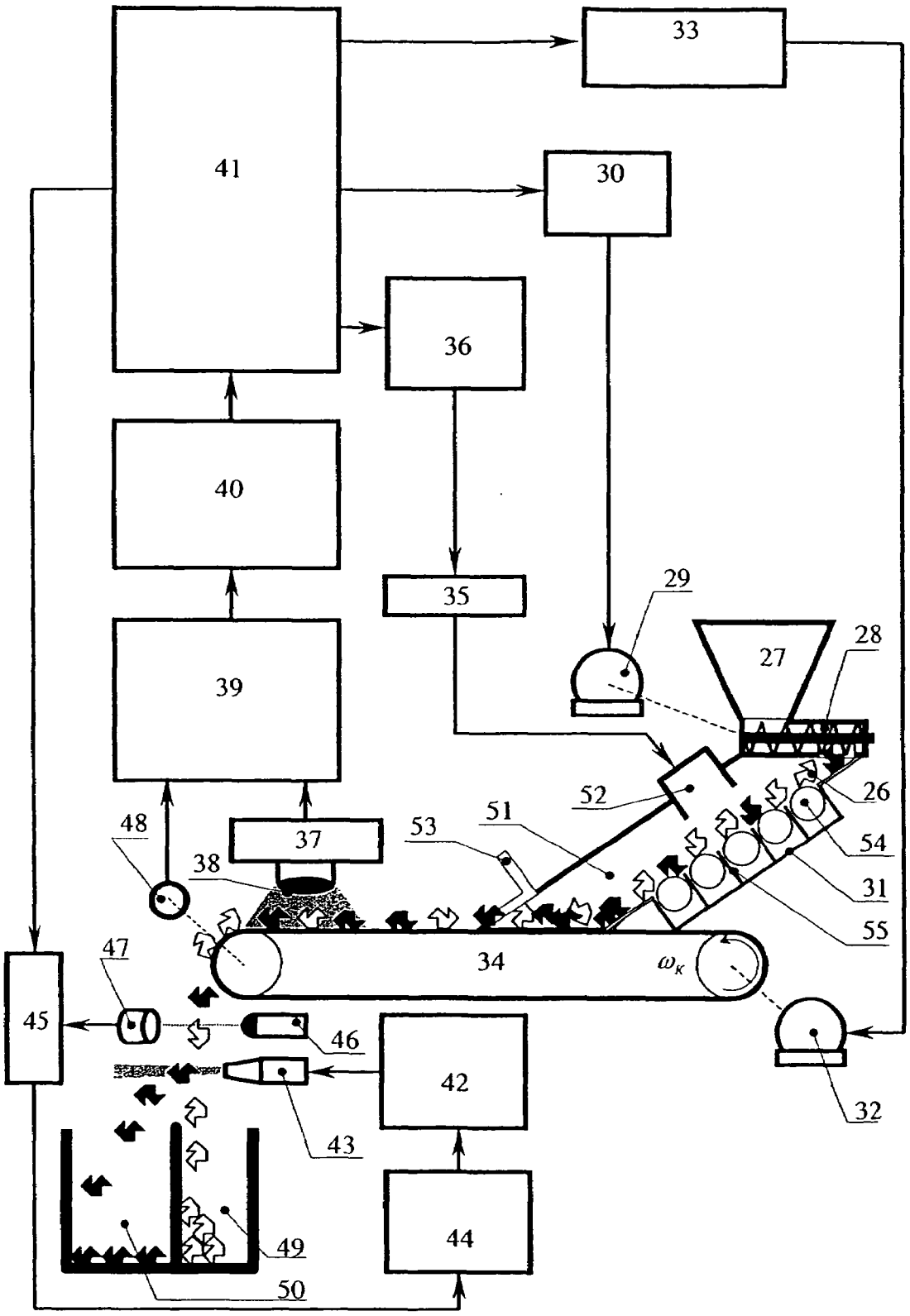
FIG. 3 is a schematic representation of a second apparatus for thermographically separating lumpy feedstock.

The second apparatus is illustrated in FIG. 3 The apparatus comprises a dosed feeding facility of feedstock lumps 26, which consists of: a receiving bin 27, a screw feeder 28 with electric drive 29 and screw feeder electric drive control system 30; a conveyer 34 with an electric drive 32 and a conveyer electric drive control system 33; a microwave heating chamber 51 which includes a rolling handler 31 comprising heat resistant dielectric rollers 54, between which are elements of a decelerating comb 55; a microwave generator 35 with a microwave energy inlet element 52, a lump discharge unit 53 from the microwave heating chamber, a microwave generator control system 36; a thermographic system 37 with heat-sensing devices 38; an input interface 39, a computing device 40, an output interface 41; a control pulse shaper 42 for solenoid-operated pneumatic valve 43, a time delay unit 44, a comparator 45; a narrow-beam light emitter 46, a photodetector 47; a position handler 48; a separation device with a worthless material receiving bin 49 and a concentrate receiving bin 50.

Furthermore, the outlet of the thermographic system is connected with the first inlet of the input interface 39, whose outlet is connected via the comparator 40 with inlet of the output interface 41; the first outlet of the output interface 41 is connected with the first inlet of the comparator 45, whose second inlet is connected with outlet of the photodetector 47 of the narrow-beam light emitter 46, and the outlet of the comparator 45 via a time delay unit 44 and a control pulse shaper 42 is connected with the inlet of the solenoid-operated pneumatic valve 43; the second outlet of the output interface 41 is connected with the feeder electric drive control system 30 of the dosed feeding facility, the third outlet of output interface 41 is connected via the microwave facility 36 with the microwave generator 35, and its outlet is connected via the microwave energy inlet element 52 with the microwave heating chamber 51; the fourth outlet of the output interface 41 is connected with the conveyer electric drive control system 33 of the electric drive 32 of the conveyer 34. On the roller of the conveyer a position sensor 48 is installed which is connected with the second inlet of the input interface 39.

To exclude the possibility of microwave energy leakage into outside area dimensions of the lump discharge unit 53 are chosen such that the discharge unit has the properties of a below-cutoff waveguide. In addition, to increase microwave energy leakage at the moment of lump discharge from the microwave generator 35, the lump discharge unit 53 containing quarterwave reflecting elements.

For uniform heating of the lump from all sides, odd harmonics of higher orders are provided in the microwave heating chamber 51. This is provided by choosing the microwave heating chamber geometries divisible by non-integral number of wavelengths. To increase intensity of the field and reduce electrical energy losses, the decelerating system with comb structure 55 is used in the microwave heating chamber. The system is located between the rollers 54 of the rolling handler 31. All elements of the decelerating comb 55 have height equal to ¼ of a wave length and are placed at the distance between each other equal to ¼ of microwave energy wave length as well.

EXAMPLE OF APPARATUS EMBODIMENT

The diagram of the second apparatus is presented in FIG. 1. As an embodiment variant the apparatus works as follows.

The computing device 40 via output interface 41 and the conveyer electric drive control system 33 turns on the electric drive 32 of the conveyer 34 and the rolling handler 31. Upon achieving the preset speed of the belt, which is calculated depending on data coming via input interface 39 from the position sensor of the conveyer 48, the computing device 40 via output interface 41 and feeder electric drive control system 30 turns on the electric drive 29 of the feeder 28. Simultaneously, the computing device 40 via output interface 41 and microwave facility control system 36 turns on the microwave generator 35 and presets the required microwave radiation power. Feedstock lumps from the receiving bin 27 are fed onto the rolling handler 31. Moving on the rolling handler, the feedstock lumps are distributed on the surface of the rolling handler in one layer. This provides a one-layer feeding of the conveyer 34. Simultaneously, the lumps undergo microwave electromagnetic field energy effect which comes into the microwave heating chamber 51 from the microwave generator 35 via the microwave energy inlet element 52.

While in the microwave electromagnetic field effective area, the feedstock lumps are heated up to the temperature whose value is specified by properties of the lump material and by the time of microwave electromagnetic field effect. The time of effect of microwave electromagnetic field effect on the feedstock lumps in the given apparatus is preset from the condition of the required heating level of the feedstock lumps and is defined by the speed of the conveyer 34 which is to be in accord with the feeding capacity of the feeder 28.

The signal from the position sensor of the conveyer 48 via input interface 39 goes into the computing device 40 which via output interface 41 forms the control signal for the conveyer electric drive control system 33 and a corresponding control signal for the feeder electric drive control system 30 which provide matched velocities of the conveyer electric drive 32 and the feeder electric drive 29 providing presence of feedstock lumps in the microwave heating chamber 51 for a preset time.

The required linear speed of the conveyer belt $V_K$ can be defined by formula:

$$V_{\hat{E}} = \frac{L_f}{t_f} \text{ (m/s)},$$

where $t_H$—time of microwave electromagnetic field effect on the controlled lumps is defined by formula (11)(seconds);

$L_H$—equivalent linear dimension of microwave electromagnetic field radiation zone along velocity vector of moving of lumps (m).

After passing the lump discharge unit 53, the heated lumps go into heat-sensing devices effective area 38, and a thermal image of the controlled lumps is fixed by the thermographic system 37. The output signal of the thermographic system 37 via input interface 39 goes into the computing device 40 which, according to the thermal image of the lump, defines medium temperature of the lump, then weight fraction of valuable constituent in the controlled lump in accordance with formula (46).

$$Q = \frac{\rho_r Ae}{\rho_r Ae - \rho Ae_r}$$

the condition is checked: $Q \geqq Q_{nop}$.

At exceeding of weight fraction of valuable constituent in the controlled lump of a preset threshold value, after the lump reaches a drop point from the conveyer 34, which is controlled by the position sensor 48, the computing device 40 with a dwell a little less than the time of dropping of the lump from the drop point from the conveyer till the point of intersection of a narrow beam of the narrow-beam light emitter 46, via the output interface 41 gives an enable signal to the comparator 45. The moment the lump intersects a narrow beam of the narrow-beam light emitter 46, a signal is formed at the outlet of the photodetector 47, which is given to the second inlet of the comparator 45. When signals at both inlets of the comparator 45 coincide, a signal is formed at the outlet of the comparator. With a dwell defined by the flyby time of the lump from the narrow-beam light emitter 46 till the axis of the solenoid-operated pneumatic valve 43 and preset by the time delay unit 44, via the control pulse shaper 42, the signal opens the solenoid-operated pneumatic valve 43. At opening of the solenoid-operated pneumatic valve an air stream is formed at the nozzle outlet. Under the effect of the air stream the mechanical trajectory of the lump is modified so that it drops into the concentrate receiving bin 50. If weight fraction of valuable constituent in the controlled lump does not exceed the preset threshold value, the computing device 40 does not give an enable signal to the comparator 45 and when the lump intersects the narrow beam of the narrow-beam light emitter 21, a signal does not appear at its outlet. As a result, the solenoid-operated pneumatic valve does not open and the lump does not change its mechanical trajectory, thus allowing drop of the lump into the worthless material receiving bin 49.

The proposed methods and apparatus of thermographic lump separation allow to significantly improve technological activities of feedstock concentration.

As studies and tests have shown, the proposed lump separation apparatus allow under equal conditions and loads to increase valuable constituent content from 6% -10% up to 18% -25%, weight fraction of valuable constituent by 4.5% at valuable constituent content in the reject material decreasing down to 3%, and to reduce overall energy consumption by 5% due to decrease of feedstock impoverishment in the process of concentration.

The proposed apparatus comprises separate units of general industrial application and special equipment which is released by industry and available at the market.

To manufacture the present apparatus there is no need in development and release of new equipment specially designed for manufacturing of the present apparatus. To manufacture the proposed apparatus there is need in engineering logical design of the apparatus operation, software for the computing device and coupling of units of general industrial and special function.

The invention claimed is:

1. A method of thermographically separating lumpy feedstock, the method comprising feeding the feedstock lump by lump, exposing the feedstock to microwave radiation, recording induced radiation, detecting a valuable constituent, comparing the weight fraction of the valuable constituent in a lump with the threshold value of the fraction, and separating the lumps into useful aggregates and worthless material from the comparison, characterised in that each lump of the feedstock is exposed to microwave radiation, wherein upon interruption of the exposure with the heat exchanging processes between constituents of a target lump being damped, the heating pattern of the target lump is recorded wherefrom the mean temperature of the target lump is first measured and then the weight fraction of the valuable constituent in the target lump is found by the formula:

$$Q = \frac{(T_U - T_O)c}{U_O c_r - T_U(c_r - c) - T_O c},$$

wherein

Q is a weight fraction of a valuable constituent in a lump;

$T_U$ is the steady-state temperature of a target lump;

$T_O$ is the temperature of worthless material, to which it was heated;

$U_O$ is the temperature of a valuable constituent, to which it was heated;

$c_r$ is the heat capacity of a valuable constituent;

c is the heat capacity of worthless material; then the condition $$Q \geqq Q_{nop},$$

wherein $Q_{nop}$ is a threshold value of the weight fraction of a valuable constituent in a lump, is verified, whereafter, from the finding of the weight fraction of the valuable constituent, the lumps of the feedstock are separated into two streams: one stream consisting of the lumps where the valuable constituent is present in an amount that is less than a predetermined threshold value, while the other stream consisting of the lumps where the valuable constituent is present in an amount that is not less than the same threshold value.

* * * * *